US008886108B2

(12) United States Patent
Suzuki

(10) Patent No.: US 8,886,108 B2
(45) Date of Patent: Nov. 11, 2014

(54) FOIL TRANSFERRING APPARATUS AND IMAGE FORMING SYSTEM USING THE SAME

(71) Applicant: Konica Minolta, Inc., Tokyo (JP)

(72) Inventor: Tomoo Suzuki, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 80 days.

(21) Appl. No.: 13/862,617

(22) Filed: Apr. 15, 2013

(65) Prior Publication Data

US 2013/0279952 A1 Oct. 24, 2013

(30) Foreign Application Priority Data

Apr. 18, 2012 (JP) ..... 2012-94739
Mar. 27, 2013 (JP) ..... 2013-67453

(51) Int. Cl.
*G03G 15/16* (2006.01)

(52) U.S. Cl.
CPC ..... *G03G 15/1665* (2013.01)
USPC ..... 399/341; 399/297; 399/306; 430/126.1

(58) Field of Classification Search
CPC ..... G03G 15/16; G03G 15/1625; G03G 15/1665; G03G 15/6582; G03G 7/0093
USPC ..... 399/66, 297, 306, 307, 341; 430/48, 430/126.1
See application file for complete search history.

(56) References Cited

U.S. PATENT DOCUMENTS

2006/0145467 A1* 7/2006 Burchard ..... 283/72
2008/0241718 A1* 10/2008 Weber ..... 430/48
2009/0211468 A1* 8/2009 Steuer ..... 101/23

FOREIGN PATENT DOCUMENTS

JP 62-255184 A 11/1987
JP 63-286399 A 11/1988

* cited by examiner

*Primary Examiner* — Walter L Lindsay, Jr.
*Assistant Examiner* — Jessica L Eley
(74) *Attorney, Agent, or Firm* — Lucas & Mercanti, LLP

(57) ABSTRACT

A second thermal transfer portion of upstream side transfers a foil image, to be not printed, from the foil sheet on a waste sheet, conveyed from an image forming apparatus, on which a desired negative toner image is transferred. The foil image, to be printed, remains on the transferred foil sheet. The waste sheet is ejected out of a foil transferring apparatus. A printing sheet of paper on which the desired positive toner image is transferred is conveyed from the image forming apparatus to a first thermal transfer portion of downstream side to meet time when the foil sheet on which the foil image, to be printed, remains reaches the first thermal transfer portion. The first thermal transfer portion transfers the foil image, to be printed, from the foil sheet on the conveyed printing sheet of paper on which the desired positive toner image is transferred.

12 Claims, 12 Drawing Sheets

500 (504)
504
502
Pn
510
512

500
510
512
Pn
502
504

500 (504)
504a
504b 504a
504b
Pn
510
504c
512

500 (504)
504b
504a
504b
504a
504b
500
504
502
Pp
520
522
524
Star Beer
522
520
522
Pp 500
504a
(520)
504b
(522)
Star Beer
Pp
500
502
504
Pp
522
504a
520
504b 500(504)
504b
500
504
502
504b Pp
504a
522
524
Star Beer
504a
522
Pp
522
520

FOIL TRANSFERRING APPARATUS AND IMAGE FORMING SYSTEM USING THE SAME

CROSS REFERENCE TO RELATED APPLICATION

The present invention contains subject matter related to Japanese Patent Application Nos. JP 2012-094739 and JP2013-67453 filed in the Japanese Patent Office on Apr. 18, 2012 and Mar. 27, 2013, the entire contents of which being incorporated herein by reference.

BACKGROUND OF THE INVENTION

1. Field of the Invention

The present invention relates to a foil transferring apparatus and an image forming system using the same, in which a desired positive foil image is transferred on a desired toner image among all the toner images on the base material using a fusion action or a toner.

2. Description of Related Art

In a bookbinding field, a commercial printing field, a card business field or a plastic molding field such as cosmetic container, printing has been performed such that a character and/or a picture image made of foil are transferred to the base material in order to give metallic appearance or a high-quality glossy image to a product, which cannot be expressed merely by common printing. In recent years, foil transferring technology has been utilized for anti-counterfeiting a cash card or a credit card and for a hologram provided for a security.

As the foil transferring technology, for example, Japanese Patent Application Publication No. S62-255184 discloses a thermal transfer printing apparatus in which a foil sheet having a foil layer on a film base member is placed on base material having a toner image for electrostatic copying while the foil layer overlaps the toner image to each other and by applying any pressure on them from above, the foil layer is transferred to the toner image.

Further, Japanese Patent Application Publication No. S63-286399 discloses a foil image forming method for forming the foil image. In this method, a toner image is formed on a sheet, a color foil is applied thereto using a thermo compression bonding, and a foil image is transferred to supporting medium using the color foil in which a color layer of the contacting portion thereof with the toner image is removed from a foil main body. Namely, in this foil image forming method, an foil image is formed by the following steps of: (1) A negative image in which an original image is reversed is copied to form a negative image copy; (2) Plastic foil for foil-stamping is stamped to the negative image copy using a thermo compression bonding; (3) By then removing them from each other, a color layer of a toner contacting portion is adhered onto the negative image copy and remained thereon; (4) A positive image of the original image is thus formed on the plastic foil for foil-stamping; and (5) The positive image of the original image is stamped to supporting medium such as polyvinyl chloride sheet using a thermo transfer printing.

SUMMARY OF THE INVENTION

In a foil transferring method of the thermal transfer printing apparatus disclosed in Japanese Patent Application Publication No. S62-255184, however, when any tonner image(s) other than the above-mentioned desired toner image on which the foil image is to be transferred is forced on the base material, the toner images may be thermally fused to have a fusion function to adhere the foil images to be transferred, so that the foil images are not only transferred to a desired toner image for adhering the target foil image bat also other toner image(s) which has (have) already formed on the base material, for example, toner image such as a design image. In other words, the foil images may be transferred to all the toner images formed on the base material. As a result thereof, it is difficult to provide a foil transferring apparatus and an image forming system using the same in which only a desired target foil image is transferred.

Further, in the foil image forming method of Japanese Patent Application Publication No. S63-286399, when transferring the foil image on the base material, a printing method is adapted in which by removing the plastic foil for foil-stamping and the negative image copy from each other after the plastic foil for foil-stamping is stamped to the negative toner image using the thermo compression bonding, the color layer of the contacting portion with the negative toner image is adhered onto the negative image copy and is remained thereon so that an extra portion of the foil is previously removed. Accordingly, plain paper sheets on which a positive toner image or a negative toner image is printed is prepared and plural steps of adhering the foil sheet so the plain paper sheet using the thermo compression bonding are performed under manual operation or in separate apparatuses. It is thus difficult to transfer the foil image automatically with high accuracy. Further, in this case, it is difficult to perform the foil printing steps successively.

This invention addresses the above-mentioned issues and has an object to provide an improved foil transferring apparatus and an improved image forming system.

To achieve the above-mentioned object, a foil transferring apparatus reflecting one aspect of the present invention, which transfers a desired positive foil image on a desired positive toner image selected among all the toner images formed on first base material using a fusion action of a toner, contains a setting portion that sets a roll on which a foil sheet including a foil layer on a surface thereof is wound, a reel portion that winds the foil sheet of the roll, a driving portion that conveys the foil sheet to the reel portion, a foil sheet conveying path on which the foil sheet is conveyed by the driving portion, a second thermal transfer portion that transfers a desired negative foil image to a second base material from the foil sheet, the second thermal transfer portion being positioned at an upstream side of the foil sheet conveying path, a first thermal transfer portion that transfers a desired positive foil image, which is not transferred to the second base material by the second thermal transfer portion, to a first base material, the first thermal transfer portion being positioned at a downstream side of the foil sheet conveying path, an entrance through which the first and second base materials are passed, a first conveying path on which the first base material is conveyed from the entrance to the first thermal transfer portion, a second conveying path on which the second base material is conveyed from the entrance to the second thermal transfer portion, a switching portion that switches the conveying path from the first conveying path to the second conveying path or from the second conveying path to the first conveying path, and a control portion that controls the switching operation of the switching portion, wherein the control portion, controls the switching portion to switch the conveying path from the first conveying path to the second conveying path when the first base material is conveyed and to switch the conveying path from the second conveying path to the first conveying path when the second base material is conveyed.

It is desirable to provide the foil transferring apparatus further containing a first paper ejection path that ejects the first base material on which the desired positive foil image is transferred in the first thermal transfer portion, a second paper ejection path that ejects the second base material on which the desired negative foil image is transferred in the second thermal transfer portion and an intersection portion that intersects the first conveying path and the second paper ejection path, wherein the control portion controls a conveyance of at least one of the first base material and the second base material in order to avoid colliding the first base material conveyed on the first conveying path with the second base material conveyed on the second paper ejection path in the intersection portion.

It is also desirable to provide the foil transferring apparatus further containing a first detection portion that detects a position of an end of the first base material passing through the first conveying path, a second detection portion that detects a position of an end of the second base material passing through the second conveying path, and an adjusting portion that adjusts a positional deviation of the first base material in relation to the second base material along a direction which is perpendicular to a conveying direction of the first base material, wherein the control portion controls the adjusting portion to move the first base material to the direction which is perpendicular to the conveying direction of the first base material based on detection results of the positions of the ends of the first and second base materials by the first and second detection portions.

It is still desirable to provide the foil transferring apparatus further containing a reverse conveying path in which the second base material on which the desired negative foil image is transferred is reversed and conveyed again to the second conveying path.

It is further desirable to provide the foil transferring apparatus further containing a manipulation/display portion that sets an image relating to a foil processing area in which the foil is transferred onto the image selected among all the images.

It is additionally desirable to provide the foil transferring apparatus wherein all the toner images including the desired positive toner image are transferred to the first base material in order to transfer the desired positive foil image, and the desired negative toner image is transferred to the second base material in order to transfer the desired negative foil image.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe preferred embodiments relating to the invention with reference to drawings. It is to be noted that the description in the embodiments is exemplified and any technical scope of the claims and/or meaning of term(s) claimed in the claims are not limited thereto.

First Embodiment

Configuration Example of Image Forming System

Figure 1:
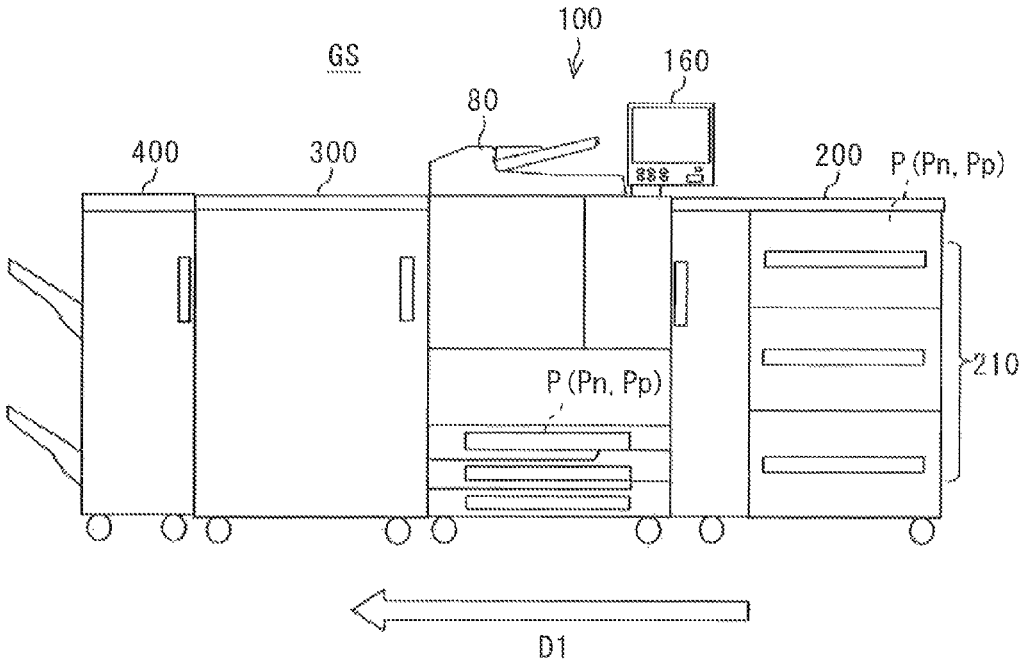
FIG. 1 is a diagram of an image forming system according to a first embodiment of this invention showing a configuration example thereof.

The following will describe an embodiment of an image forming system GS relating to the invention with reference to drawings. FIG. 1 shows a configuration example of the image forming system GS. It is to be noted that a size and a ratio in each of the drawings are exaggerated for convenience of explanation and the ratio may be different from the actual one. As shown in FIG. 1, the image forming system GS according to the invention is provided with a feeder 200, an image forming apparatus 100, a foil transferring apparatus 300 and a finisher 400. In FIG. 1, a sign, "D1" indicates a sheet-conveying direction.

The feeder 200 connects the image forming apparatus 100 at an upstream side along the sheet-conveying direction D1 of a sheet of paper P. The feeder 200 contains plural feeding trays 210 which contain a large quantity of sheets of paper P. The sheet of paper P includes a waste sheet Pn (second base material) on which a desired negative foil image, which is not printed, is transferred and a printing sheet of paper Pp (first base material) on which a desired positive foil image is transferred. The feeder 200 feeds the sheets of paper P one by one from a feeding tray 210 which contains user specified sheets of paper while they are separated by a fan, an absorption conveying portion and the like. The feeder 200 conveys the fed sheet of paper P to the image forming apparatus 100 positioned at downstream side along the sheet-conveying direction through the conveying rollers or the like. It is to be noted that although one feeder 200 has boon used in this embodiment, the invention is not limited thereto: more than one feeder 200 may be connected.

The image forming apparatus 100 connects the feeder 200 at a downstream side along the sheet-conveying direction D1 of the sheet of paper P. The image forming apparatus 100 transfers a desired negative toner image, which is used for allowing the desired negative toner image to be adhered on the desired negative foil image so that the desired negative foil image can be removed therefrom, on the waste sheet Pn that is fed from the feeder 200 or a feeding portion 20 (see FIG. 2) in the image forming apparatus 100 and conveys the waste sheet Pn to the following foil transferring apparatus 300. The image forming apparatus 100 also transfers all the toner images including a desired positive toner image which is used for allowing the desired positive foil image to be adhered thereon, to the printing sheet of paper Pp that is fed from the feeder 200 or the like and conveys the printing sheet of paper Pp to the following foil transferring apparatus 300. The image forming apparatus 100 will be described more in detail later.

The image forming apparatus 100 is also provided with a manipulation/display portion 160 for allowing a user to set various kinds of conditions about a foil transferring process. The manipulation/display portion 160 is positioned on a case body of the image forming apparatus. The manipulation/display portion 160 includes a touch panel composed of, for example, liquid crystal display (LCD) and hard keys positioned on a periphery of the touch panel such as numeral buttons and a printing start button and the like.

The foil transferring apparatus 300 connects the image forming apparatus 100 at a downstream side along the sheet-conveying direction D1 of the sheet of paper P. The foil transferring apparatus 300 heats and presses a foil sheet on the waste sheet Pn, on which the desired negative toner image is transferred, conveyed from the image forming apparatus 100 to transfer the desired negative foil image, to be not printed. The foil transferring apparatus 300 ejects the waste sheet Pn as the waste paper. After the foil transferring apparatus 300 has finished to transfer the desired negative toner image, the foil transferring apparatus 300 heats and presses a foil sheet on the printing sheet of paper Pp, on which all the toner images including the desired positive toner image are transferred, conveyed from the image forming apparatus 100 to transfer the desired positive foil image, to be printed, which is remained in the foil sheet, with high accuracy. The printing sheet of paper Pp, on which the desired positive foil image as transferred, and the waste sheet Pn, on which the desired negative foil image, to be not printed, is transferred, are conveyed to the following finisher 400. The foil transferring apparatus 300 will be described more in detail later.

The finisher 400 connects the foil transferring apparatus 300 at a downstream side along the sheet-conveying direction D1 of the sheet of paper P. The finisher 400 performs any finisher processing such as stable-binding processing, folding processing, Z-folding processing, and booklet trimming on the sheet of paper P fed from the foil transferring apparatus 300 or the image forming apparatus 100.

Configuration Example of Image Forming Apparatus

Figure 2:
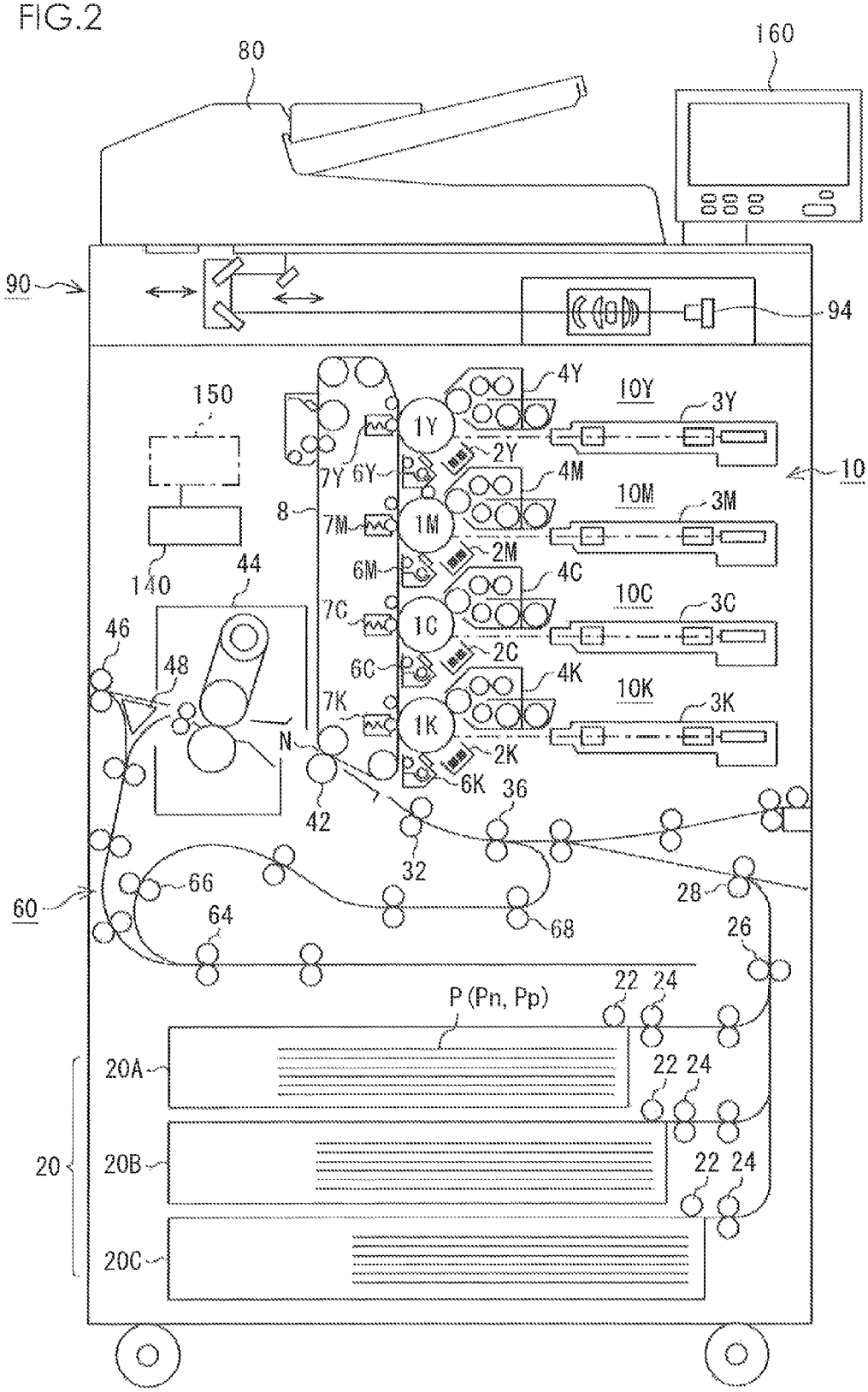
FIG. 2 is a diagram of an image forming apparatus showing a configuration example thereof.

The following will describe a configuration example of the image forming apparatus 100. FIG. 2 shows the configuration example of the image forming apparatus 100 according to this invention. As shown in FIG. 2, the image forming apparatus 100 contains a control portion 150, an image processing portion 140, the manipulation/display portion 160, an image reading portion 90, an image forming portion 10, a fixing portion 44, the feeding portion 20 and an automatic document feeding portion 80.

The control portion 150 has, for example, a central processing unit (CPU). The control portion 150 controls operations of respective portions of the image forming apparatus 100, and controls a control portion 350 (see FIG. 7) of the foil transferring apparatus 300 connecting the image forming apparatus 100 to perform the transfer processing of the foil image together with the foil transferring apparatus 300.

The image reading portion 90 irradiates light onto the documents or the like conveyed front the automatic document feeding portion 80 one by one and receives reflected light using a charge-couple device (CCD) image sensor 94 to obtain image data D. The image processing portion 140 performs various kinds of processing such as analog processing, analog/digital (A/D) conversion, compression, and the like on the image data D obtained by the image reading portion 90.

The manipulation/display portion 160 displays a selection screen for setting of a species of the sheet of paper P to be used as base material and for selecting setting of image data Dp of foil processing area on which the foil is transferred among all the items of image data. The manipulation/display portion 160 also allows the user to select the species of the sheet of paper P and select the foil processing area. It is to be noted that the manipulation/display portion 160 may be installed in the foil transferring apparatus 300. A method how to set the foil processing area among all the items of image data is performed by using any setting of an attribute of the image data D such as character, representation, graphic and the like, using any setting based on the selection of the foil processing area by inputting coordinates or the like.

Figure 7:
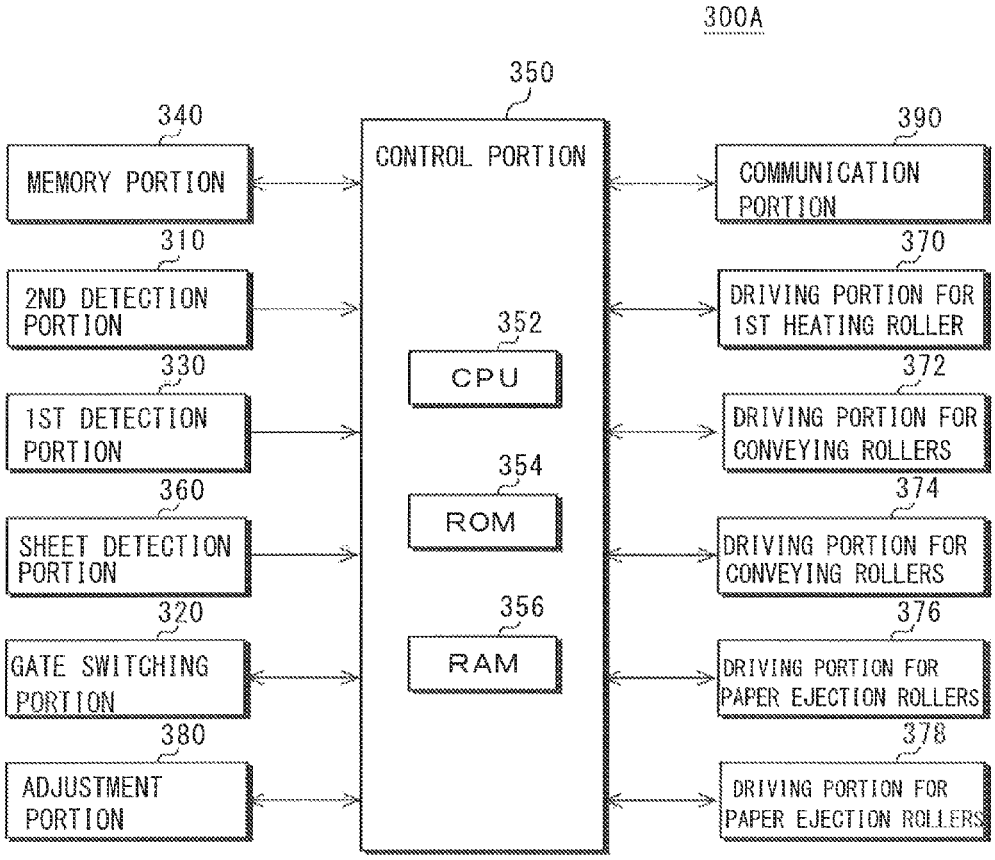
FIG. 7 is a block diagram of the foil transferring apparatus showing a configuration example thereof.

The image processing portion 140 forms desired negative image data Dn which reverses desired positive image data Dp corresponding to the selected foil processing area among items of image data D and outputs the desired negative image data Dn to the foil transferring apparatus 300 (see FIG. 7).

The image forming portions 10 forms an image under an electrophotographic system. The image forming portion 10 includes an image forming unit 10Y which forms a yellow (Y) image, an image forming unit 10M which forms a magenta (M) image, an image forming unit 10C which forms a cyan (C) image and an image forming unit 10K which forms a black (K) image. The image forming portion 10 also includes an intermediate transfer belt 8 charging toner images formed by the image forming units 10Y, 10M, 10C and 10K and secondary transfer rollers 42 forming a secondary transfer portion N for transferring the toner images on the intermediate transfer belt 8 on the sheet of paper P.

The image forming unit 10Y contains a photosensitive drum 1Y, a charging portion 2Y positioned around the photosensitive drum 1Y, an exposing (writing) portion 3Y, a developing portion 4Y and a cleaning portion 6Y. The image forming unit 10M contains a photosensitive drum 1M, a charging portion 2M positioned around the photosensitive drum 1M, an exposing portion 3M, a developing portion 4M and a cleaning portion 6M. The image forming unit 10C contains a photosensitive drum 1C, a charging portion 2C positioned around the photosensitive drum 1C, an exposing portion 3C, a developing portion 4C and a cleaning portion 6C. The image forming unit 10K contains a photosensitive drum 1K, a charging portion 2K positioned around the photosensitive drum 1K, an exposing portion 3K, a developing portion 4K and a cleaning portion 6K, The photosensitive drums 1Y, 1M, 1C and 1K, the charging portions 2Y, 2M, 2C and 2K, the exposing portions 3Y, 3M, 3C and 3K, the developing portions 4Y, 4M, 4C and 4K, and the cleaning portions 6Y, 6M, 6C and 6K in the image forming units 10Y, 10M, 10C and 10K respectively have the common configuration to each other. The following will describe them with omitting the detailed explanation of the image forming units 10M, 10C and 10K and indicate them without attaching Y, M, C, K thereto apart from cases in which any differentiation is required.

The charging portions 2 charge a static charge uniformly around surfaces of the photosensitive drums 1. Each of the exposing portions 3 is composed of, for example, an LED print head (LPH) including LED array and focusing lens or a laser scan and exposure unit of polygon mirror system. The exposing portions 3 scan surfaces of the photosensitive drums 1 using laser beam based on the image data to form electrostatic latent images. The developing portions 4 develop the electrostatic latent images formed on the surfaces of the photosensitive drums 1 by using the toners. Accordingly, visible toner images are formed on the photosensitive drums 1.

The intermediate transfer belt 8 is stretched across plural rollers so as to be able to run around them. When driving primary transfer rollers 7Y, the intermediate transfer belt 8 runs and the toner images of each color formed on the respective photosensitive drums 1 are transferred onto their image transfer positions of the intermediate transfer belt 8 (primary transfer). In this embodiment, when specifying a foil processing area, to be printed, the desired negative toner images which reverse the desired positive images of the foil processing area to be printed are formed on the respective photosensitive drums 1 and then, all the toner usages including the desired positive toner image corresponding to the desired positive foil image, to be printed, and other toner image such as characters or design images on which the foil is not transferred are formed on the respective photosensitive drums 1.

The feeding portion 20 includes plural feeding trays 20A, 20B and 20C each containing sheets of paper with various kinds of sheet sizes such as A3 and A4. Each of the feeding trays 20A, 20B and 20C is provided with pick-up rollers 22 for feeding the sheet of paper P from each feeding tray and handling rollers 24 for preventing a multiple of sheets of paper from being sent from each feeding tray. The feeding portion 20 feeds the sheet of paper P from the feeding tray selected on the manipulation/display portion 160 using the pick-up rollers 22 and the like and conveys the fed sheet of paper P to registration rollers 32 via the conveying rollers 26, 28, 36 and the like. In this embodiment, the waste sheet Pn for transferring the desired negative foil image, to be not printed, and the printing sheet of paper Pp for transferring the desired positive foil image, to be printed, are fed alternately according to a number of images.

The registration rollers 32 correct a deflection of the sheet of paper P by hitting a forward end of the sheet of paper P thereto. When finishing the correction, the sheet of paper P is conveyed to the secondary transfer rollers 42 of the secondary transfer portion N at a predetermined timing. In the secondary transfer portion N, color toner images transferred on the intermediate transfer belt 8 are secondarily transferred on a surface of the sheet of paper P collectively. In this embodiment, the desired negative toner image for transferring the desired negative foil image, to be not printed, is transferred on the waste sheet Pn fed from the feeding portion 20. Further, all the toner images including the desired positive toner image corresponding to the desired positive foil image, to be printed, and other toner images are transferred on the printing sheet of paper Pp fed from the feeding portion 20. The sheet of paper P which has been secondarily transferred is conveyed to the fixing portion 44.

The fixing portion 44 is provided at downstream side of the secondary transfer portion N along the sheet-conveying direction of the sheet of paper P. The fixing portion 44 contains a pressure roller, a heating roller and the like. The fixing portion 44 fixes the toner image on the surface of the sheet of paper P by applying pressure to the sheet of paper P onto which the secondary transfer portion N has transferred the toner image and/or heating the same.

A route changing portion 48 for changing the conveying rote of the sheet of paper P to a side of paper ejection route or a side of a reverse conveying path is provided at downstream side of the fixing portion 44 along the sheet-conveying direction of the sheet of paper P. The route changing portion 48 changes the conveying route based on the selected printing mode (a single-side printing mode or a duplex printing mode).

The sheet of paper P which is printed during the single-side printing mode or the sheet of paper P, both surfaces of which are printed during the duplex printing mode is conveyed to the foil transferring apparatus 300 by sheet ejection rollers 46 after the sheet of paper P has been fixed in the fixing portion 44.

On the other hand, when the sheet of paper P is reversed daring the duplex printing mode, the sheet of paper P, on a front surface of which the image has been formed, is conveyed to a reverse conveying path 60 via the route changing portion 48. The sheet of paper P conveyed to the reverse route 60 is conveyed to a switchback route under an inverse rotation control of ADU rollers 64 with a rear end thereof facing ahead thereof. The sheet of paper P is again fed to the image forming portion 10 through the conveying rollers 66, 68 and the like. On a back surface of the sheet of paper P again conveyed to the image forming portion 10, the desired toner image is formed in the secondary transfer portion N like the image forming process of front side of the sheet of paper P. In this embodiment, when the desired negative toner images are transferred on both surface of the waste sheet Pn, the desired negative toner image is transferred on the back surface of the sheet of paper P by reversing the waste sheet Pn. The sheet of paper P, on the back surface of which the desired negative toner image has been transferred by the image forming portion 10, is conveyed to the foil transferring apparatus 300 through the paper ejection rollers 46 and the like after the fixing portion 44 fixes the sheet of paper P.

Configuration Example of Waste Sheet

Figure 3A:
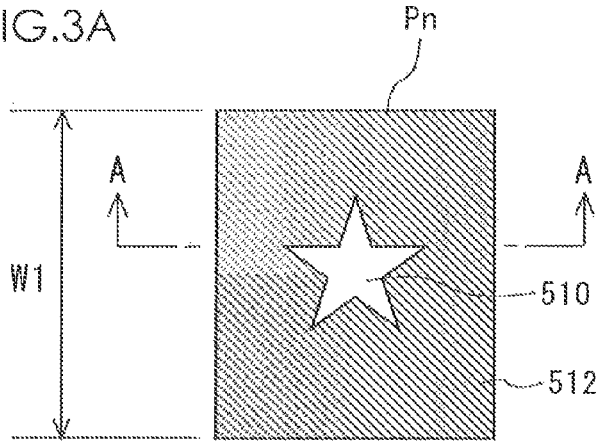
FIG. 3A is an illustration of a waste sheet and FIG. 3B is a sectional view thereof, taken along lines A-A.
Figure 3B:
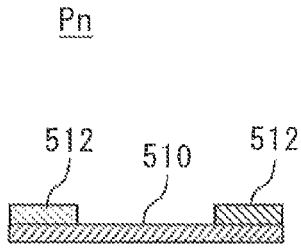

The follow will describe the waste sheet Pn on which the desired negative foil image, to be not printed, is transferred by the image forming apparatus 100. FIG. 3A shows the waste sheet Pn on which the desired negative toner image 512 is transferred. FIG. 3B is a sectional view thereof, taken along lines A-A. It is to be noted that in the following description, a case where the desired positive foil image to be transferred to the printing sheet of paper Pp is a star image will be described.

As shown in FIGS. 3A and 3B, in the waste sheet Pn, the desired negative toner image 512 that reverses the star image is transferred on an area corresponding to the desired negative foil image excluding the star image that is transferred to the printing sheet of paper Pp. On the other hand, an area on which the desired positive foil image having the star image is transferred becomes a recessed portion 510 from which the star image is removed. The recessed portion 510 has the same size as that of the desired positive foil image to be printed. The waste sheet Pn has a length W1 along a longitudinal direction thereof.

Configuration Example of Printing Sheet of Paper

Figure 4A:
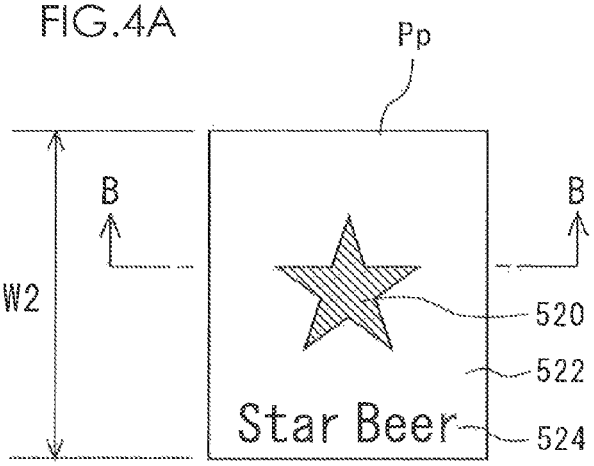
FIG. 4A is an illustration of a printing sheet and FIG. 4B is a sectional view thereof, taken along lines B-B.
Figure 4B:
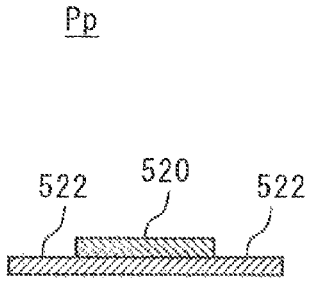

The follow will describe the printing sheet of paper Pp on which the desired positive foil image, to be printed, is transferred. FIG. 4A shows the printing sheet of paper Pp on which the desired positive toner image 520 is transferred. FIG. 4B is a sectional view thereof, taken along lines B-B. It is to be noted that in the following description, a case where the desired positive foil image to be transferred to the printing sheet of paper Pp is a star image will be described.

As shown in FIGS. 4A and 4B, in the printing sheet of paper Pp, the desired positive toner image 520 of star image that has the same size as that of the desired positive foil image to be printed is transferred to a middle area of the printing sheet of paper Pp on which the desired positive foil image of the star image is transferred. On the other hand, an area corresponding to the desired negative foil image excluding the star image which is transferred on the printing sheet of paper Pp becomes at portion 522 on which no toner image is transferred. A toner image 524 of characters, "Star Beer" is previously transferred as a design image below the desired positive toner image 520 within a region of the portion 522. The printing sheet of paper Pn has a length W2 along at longitudinal direction thereof. In this embodiment, the printing sheet of paper Pp having the same size as that of the waste sheet Pn is used.

Configuration Example of Foil Transferring Apparatus

Figure 5:
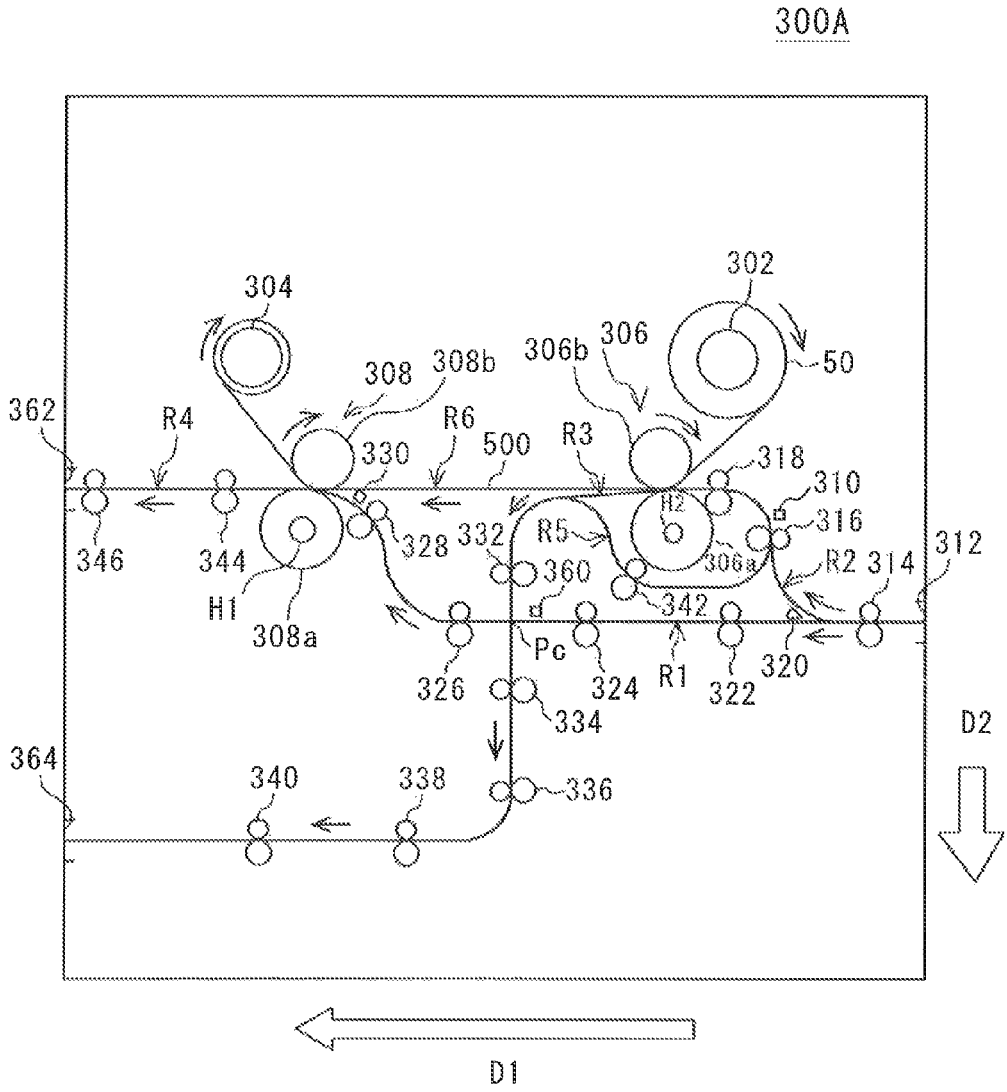
FIG. 5 is a diagram of a foil transferring apparatus according to a first embodiment of this invention showing a configuration example thereof.

The following will describe the foil transferring apparatus 300A. FIG. 5 shows a configuration example of the foil transferring apparatus 300A. As shown in FIG. 5, the foil transferring apparatus 300A is provided with a setting portion 302, a reel portion 304, a first conveying path R1, a second conveying path R2, a second paper ejection path R3, a first paper ejection path R4, a second thermal transfer portion 306, a first thermal transfer portion 308, a gate switching portion 320, a second detection portion 310, a first detection portion 330 and a sheet detection portion 360.

Figure 6A:
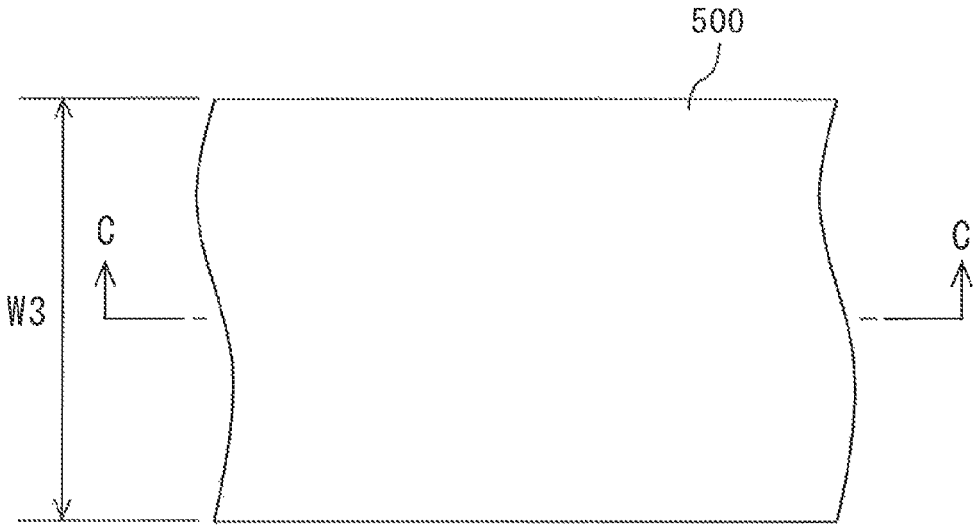
FIG. 6A is an illustration of a foil sheet showing a configuration example thereof and FIG. 6B is a sectional view thereof, taken along lines C-C.
Figure 6B:
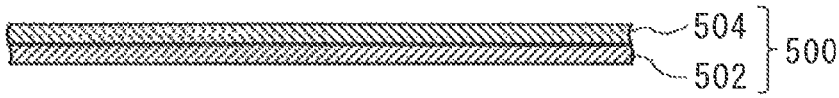

The setting portion 302 is positioned at an upstream side (a side of an entrance 312) along the sheet-conveying direction D1 of the sheet of paper P. The setting portion 302 is composed of, for example, a reel and a cartridge. The setting portion 302 is supported by an axis portion thereof, not shown, so as to be able to rotate. The setting portion 302 sets a roll 50 on which a foil sheet 500 is wound. FIG. 6A shows a configuration example of the foil sheet 500. FIG. 6B shows a section of the foil sheet 500, taken along the lines C-C. As shown in FIGS. 6A and 6B, the foil sheet 500 contains a long substrate 502 made of transparent film of, for example, heat-resistant resin and a foil layer 504 formed on this substrate 502. The foil layer 504 is formed on the substrate 502 by, for example, vaporization. The foil layer 504 is bonded the substrate 502 by van der Waals forces. The foil sheet 500 has a width W3 which is longer than the length W1 of the waste sheet Pn or the length W2 of the printing sheet of paper Pp.

The reel portion 304 is positioned at a downstream side (a side of an exit 362) along the sheet-conveying direction D1 or the sheet of paper P so as to be away from the setting portion 302 by a predetermined distance. The reel portion 304 includes a reel and is supported by an axis portion thereof, not shown, so as to be able to rotate. In this embodiment, the reel portion 304 is positioned at a level that is almost the same level as that of the setting portion 302. The reel portion 304 connects, for example, a driving portion 370 of a first heating roller 308*a*, which will be described later (see FIG. 7). It is configured that the driving portion 370 of the first heating roller 308*a* drives the reel portion 304 so as to rotate together with the first thermal transfer portion 308 positioned at the upstream side thereof.

To the reel portion 304, an end of the foil sheet 500 of the roll 50 set on the setting portion 302 is attached with the foil sheet 500 being stretched between the second thermal transfer portion 306 and the first thermal transfer portion 308, which will be described later, through the nipping portions thereof. When the reel portion 304 rotates, the foil sheet 500 set on the setting portion 302 is conveyed so as to pass through the second thermal transfer portion 306 and the first thermal transfer portion 308 and is wound on the reel portion 304. In this embodiment, a conveying path of the foil sheet 500 between the setting portion 302 and the reel portion 304 is referred to as "foil sheet conveying path R6".

The second conveying path R2 is composed of, for example, a pair of guide plates. The second conveying path R2 extends from the entrance 312 of the foil transferring apparatus 300A to the second thermal transfer portion 306 through the conveying rollers 314 and the gate switching portion 320. Other conveying rollers 316 are also positioned on the second conveying path R2. The conveying rollers 314, 316 convey the waste sheet Pn conveyed from the image forming apparatus 100 through the entrance 312 to the registration rollers 318.

The second detection portion 310 is composed of a line sensor in which photoelectric transducers are arranged so as to be lined, an image sensor in which photoelectric transducers are arranged like a matrix and the like. The second detection portion 310 is positioned at an upstream side of the registration rollers 318 along the sheet-conveying direction D1 of the sheet of paper P. The second detection portion 310 detects a position of an end of the waste sheet Pn conveyed through the second conveying path R2. The position of the end of the waste sheet Pn is used when deflection registration, which will be described later, for aligning the printing sheet of paper Pp to the waste sheet Pn is performed.

The registration rollers 318 are positioned between the second detection portion 310 and the second thermal transfer portion 306. The registration rollers 318 correct the deflection of the waste sheet Pn by hitting a forward end of the waste sheet Pn against the stopped registration rollers 318 to form a loop. The registration rollers 318 restart their rotations to convey the waste sheet Pn to the second thermal transfer portion 306 at a predetermined timing after the deflection of the waste sheet Pn has been corrected.

The second thermal transfer portion 306 is positioned at an upstream side of the foil sheet conveying path R6. The second thermal transfer portion 306 contains, for example, a heating roller 306*a* including a heater H2 and a pressure roller 306*b* arranged so as to face the heating roller 306*a*. The registration rollers 318 convey the waste sheet P and the second thermal transfer portion 306 lays the foil layer 504 of the foil sheet 500 on top of a surface of the waste sheet Pn, on which the desired negative toner image is transferred, to heat and pressure them. The waste sheet Pn is then adhered to the foil layer 504 and by removing the waste sheet Pn from the foil layer 504, the desired negative foil image is transferred onto the desired negative toner image on the waste sheet Pn. It is to be noted that the heating temperature is preferably about 100° C., for example. The waste sheet Pn on which the desired negative foil image is transferred by the second thermal transfer portion 306 is conveyed to the second paper ejection path R3.

The second paper ejection path R3 is composed of, for example, a pair of guide plates. The second paper ejection path R3 extends diagonally downward along the sheet-conveying direction D1 of the sheet of paper P from the second thermal transfer portion 306. The second paper ejection path R3 also extends by a predetermined length on a vertical direction through a corner portion. The second paper ejection path R3 further extends to the exit 364 through another corner portion. On the second paper ejection path R3, plural paper election rollers 332, 334, 336, 338 and 340 are provided. The waste sheet Pn on which the desired negative foil image, to be not printed, is transferred by the second thermal transfer portion 306 is conveyed to the exit 364 through the second paper ejection path R3 by the paper ejection rollers 332, 334, 336, 338 and 340.

Reverse conveying path R5 is composed of, for example, a pair of guide plates. The reverse conveying path R5 branches from the second paper ejection path R3 to pass through a position below the second thermal transfer portion 306 and comes together at the upstream side of the conveying rollers 316 on the second conveying path R2. On the reverse conveying path R5, conveying rollers 342 are provided. When using both surfaces of the waste sheet Pn, the waste sheet Pn, on a front surface of which the desired negative foil image, to be not printed, has been transferred in the second thermal transfer portion 306, is switched back in the second paper ejection path R3 to enter the reverse conveying path R5 where the waste sheet Pn is reversed and the reversed waste sheet Pn is again fed to the second conveying path R2. Thus, the reverse conveying path R5 is used when using both surfaces of the waste sheet Pn.

The first conveying path R1 is composed of, for example, a pair of guide plates. The first conveying path R1 horizontally extends from the entrance 312 of the foil transferring apparatus 300A to branch the second conveying path R2 toward the first thermal transfer portion 308 through the gate switching portion 320. The first conveying path R1 intersects the second paper ejection path R3 on the way to the first thermal transfer portion 308. In this embodiment, a position in which the first conveying path R1 and the second paper ejection path R3 are intersected is referred to as an "intersection point Pc". On the first conveying path R1, plural conveying rollers 322, 324 and 326 are provided. The conveying rollers 314, 322, 324 and 326 convey the printing sheet of paper Pp conveyed from the image forming apparatus 100 through the entrance 312 to the registration rollers 328.

The sheet detection portion 360 is positioned, for example, just before the intersection point Pc on the first conveying path R1. The sheet detection portion 360 is composed of, for example, a sensor of a reflection type or a transmission type. The sheet detection portion 360 detects a forward or rear end of the printing sheet of paper Pp which passes through the intersection point Pc on the first conveying path R1. This detection result of the printing sheet of paper Pp is used for conveyance control of the waste sheet Pn which waits or decreases its conveying speed before the intersection point Pc on the second paper ejection path R3.

The first detection portion 330 is composed of a line sensor in which photoelectric transducers are arranged so as to be lined or an image sensor in which photoelectric transducers are arranged like a matrix. The first detection portion 330 is positioned at a downstream side of the registration rollers 328 along the sheet-conveying direction D1 of the sheet of paper P. The first detection portion 330 detects a position of an end of the printing sheet of paper Pp conveyed through the first conveying path R1.

The registration rollers 328 are positioned at an upstream side of the first thermal transfer portion 308 along the sheet-conveying direction D1 of the sheet of paper R. The registration rollers 328 performs a registration correction to correct the deflection of the printing sheet of paper Pp by hitting a forward end of the printing sheet of paper Pp against the registration rollers 328 to form a loop. The registration rollers 328 also performs a registration fluctuation correction to move the printing sheet of paper Pp along a width direction D2 of the printing sheet of paper Pp by a difference between the position of the end of the printing sheet of paper Pp and the position of the end of the waste sheet Pn with the printing sheet of paper Pp being nipped so that the end of the printing sheet of paper Pp can align the end of the waste sheet Pn. Such registration fluctuation correction enables the printing sheet of paper Pp to align the desired positive foil image, to be printed, remained on the foil sheet 500. The registration rollers 328 convey the printing sheet of paper Pp to the first thermal transfer portion 308 to meet the time when the foil sheet 500 having the desired positive foil image reaches the first thermal transfer portion 308 after the registration fluctuation correction has been completed. The registration rollers 328 release the nipping of the printing sheet of paper Pp and return to their previously set home positions when the printing sheet of paper Pp reaches the first thermal transfer portion 308.

The first thermal transfer portion 308 is positioned at a downstream side of the foil sheet conveying path R6. The first thermal transfer portion 308 contains a heating roller 308*a* including a heater H1 and a pressure roller 308*b* arranged so as to face the heating roller 308*a*. The registration rollers 328 convey the printing sheet of paper Pp at a predetermined timing to the first thermal transfer portion 308 and the first thermal transfer portion 308 lays the foil layer 504 of the foil sheet 500 on top of a surface of the printing sheet of paper Pp, on which the desired positive toner image is transferred, to heat and pressure them. Accordingly, the desired positive foil image remained on the foil layer 504 is transferred onto the desired positive toner image on the printing sheet of paper Pp using any confusion action of the toner. It is to be noted that the heating temperature is preferably about 100° C., for example. The printing sheet of paper Pp on which the desired positive foil image, to be printed, is transferred by the first thermal transfer portion 308 is conveyed to the first paper ejection path R4.

The first paper ejection path R4 is composed of, for example, a pair of guide plates. The first paper ejection path R4 extends from the first thermal transfer portion 308 to an exit 362 horizontally. On the first paper ejection path R4, plural paper ejection rollers 344, 346 are provided. The paper ejection rollers 344, 346 convey the printing sheet of paper Pp on which the desired positive foil image, to be printed, is transferred by the first thermal transfer portion 308 to the exit 362.

Block Configuration Example of Foil Transferring Apparatus

The following will describe a block configuration example of the foil transferring apparatus 300A. FIG. 7 illustrates a block configuration example of the foil transferring apparatus 300A. As shown in FIG. 7, the foil transferring apparatus 300A contains, for example, a control portion 350 that controls operations of respective portions of the foil transferring apparatus 300A based on instructions from a main control portion 150 of the image forming apparatus 100. The control portion 350 includes a central processing unit (CPU) 352 to perform any programs for foil transfer processing, a read only memory (ROM) 345 to store control programs and a random access memory (RAM) 356 to store data temporarily.

The control portion 350 connects the second detection portion 310, the first detection portion 330, the sheet detection portion 360, the game switching portion 320, an adjustment portion, a driving portion 370 for the first heating roller, driving portions 372, 374 for conveying rollers, driving portions 376, 378 for paper ejection rollers, a memory portion 340 and a communication portion 390, respectively.

The second detection portion 310 detects the end of the waste sheet Pn passing through the second conveying path R2. The second detection portion 310 sends to the control portion 350 a detection signal obtained by this detection based on the position of the end of the waste sheet Pn. The first detection portion 330 detects the end of the printing sheet of paper Pp passing through the first conveying path R1. The first detection portion 330 sends to the control portion 350 a detection signal obtained by this detection based on the positron of the end of the printing sheet of paper Pp. The sheet detection portion 360 detects the printing sheet of paper Pp passing through the intersection Pc in the way of the first conveying path R1. The sheet detection portion 360 sends to the control portion 350 a defection signal obtained by this detection.

The gate switching portion 320 is composed of, for example, solenoid, motor and the like. The gate switching portion 320 switches each of the conveying paths of the waste sheet Pn and the printing sheet of paper Pp to the first or second conveying path R1 or R2 based on a switching signal supplied from the control portion 350. The adjustment portion 380 is composed of, for example, gears, motor and the like. The adjustment portion 360 moves the registration rollers 328 along the sheet width direction D2 based on an instruction value sent from the control portion 350.

The driving portion 370 for the first heating roller is composed of, for example, a stepping motor. The driving portion 370 for the first heating roller drives based on a driving signal received from the control portion 350 to drive the first heating roller 308*a* constituting first thermal transfer portion 308 and to allow the reel portion 304 to rotate together with the driving of the first heating roller 308*a*. An encoder may be provided to control the winding speed of the reel portion 304. It is to be noted that the reel portion 304 may be configured so as to provide another driving portion other than the driving portion 370 for the first heating roller 308*a* to wind the foil sheet.

The driving portion 372 for the conveying rollers is composed of, for example, a stepping motor. The driving portion 372 for the conveying rollers drives based on a driving signal received from the control portion 350 to drive, for example, the conveying rollers 314, 316 and the like provided on the second conveying path R2. The driving portion 374 for the conveying rollers is composed of, for example, a stepping motor. The driving portion 374 for the conveying rollers drives based on a driving signal received from the control portion 350 to drive, for example, the conveying rollers 322, 324, 326 and the like provided on the first conveying path R1.

The driving portion 376 for the second paper ejection rollers is composed of, for example, a stepping motor. The driving portion 376 for the second paper ejection rollers drives based on a driving signal received from the control portion 350 to drive, for example, the paper ejection rollers 332, 334, 336, 338, 340 and the like provided on the second paper ejection path R3. The driving portion 378 for the first paper ejection rollers is composed of, for example, a stepping motor. The driving portion 378 for the first paper ejection rollers drives based on a driving signal received from the control portion 350 to drive, for example, the paper ejection rollers 344, 346 and the like provided on the first paper ejection path R4.

The memory portion 340 is composed of, for example, a nonvolatile semiconductor memory, a hard disk drive (HDD) or the like. The memory portion 340 stores information on the positions of the ends of the waste sheet Pn and/or the printing sheet of paper Pp. The communication portion 390 is composed of various kinds of interfaces such as network interface card (NIC), modulator-DEModulator (MODEM), universal serial bus (USB) and the like and performs an interactive communication between the image forming apparatus 100 and the finisher 400.

Operation Example of Image Forming Apparatus

Figure 8:
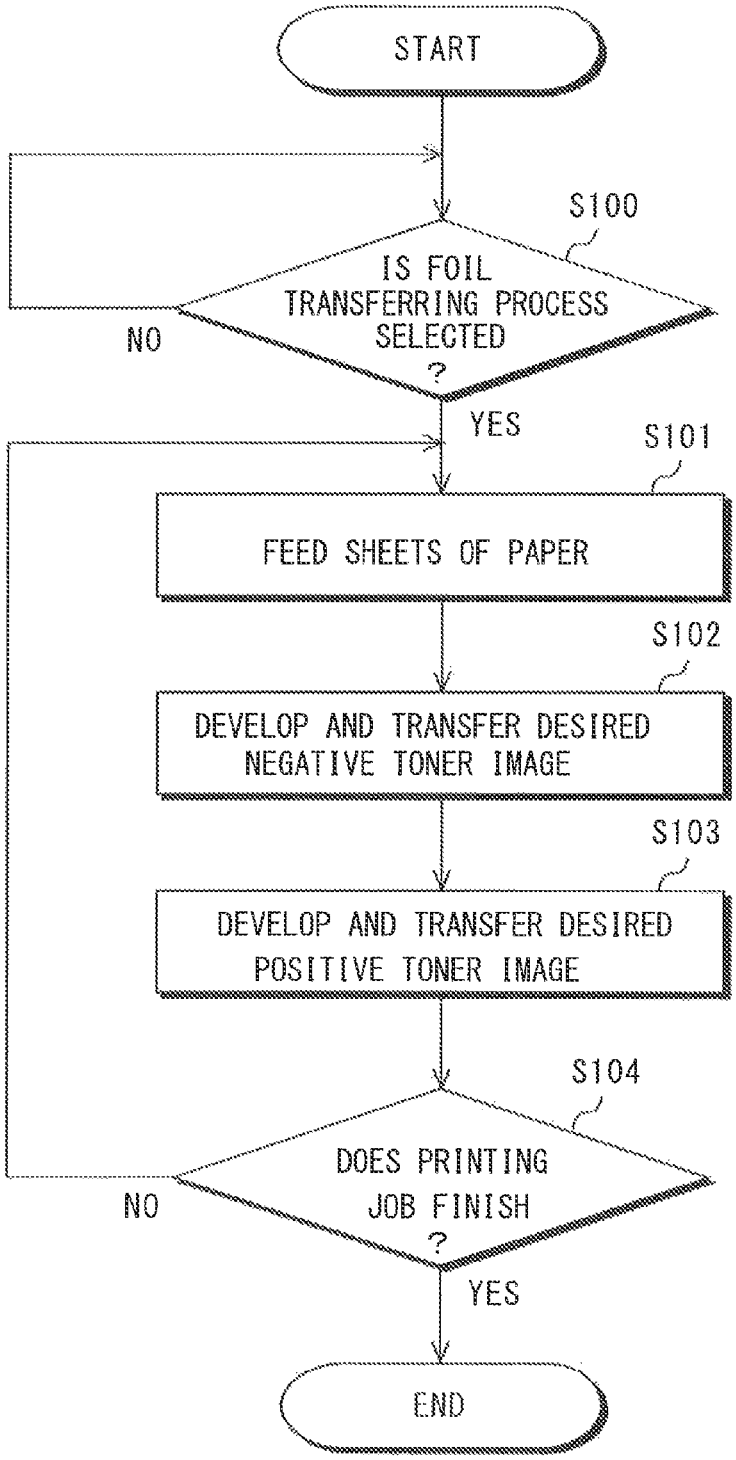
FIG. 8 is a flowchart showing an operation example of the image forming apparatus.

The following will describe an operation example of the image forming apparatus 100 when the desired positive foil image is transferred on the printing sheet of paper Pp. FIG. 8 shows an operation example of the image forming apparatus 100. In the following, a case where the feeding portion 30 of the image forming apparatus 100 feeds the waste sheet Pn and the printing sheet of paper Pp will be described and it is estimated that the waste sheet Pn and the printing sheet of paper Pp have the identical sheet size.

As shown in FIG. 8, at a step S100, the control portion 150 determines whether or not the foil transferring process is selected. For example, the control portion 150 determines whether or not a user selects the setting of a foil processing area for performing the foil transferring process on the manipulation screen of the manipulation/display portion 160 and the user selects a button for starting the foil transferring process. The control portion 150 may determine whether or not a computer connecting the image forming apparatus 100 via a network sends any information indicating a start of the foil transferring process. When selecting the foil transferring process, a printing job including image data Dn for performing the foil transferring process and any information on sheet sizes and species of the waste sheet Pn and the printing sheet of paper Pp is supplied to the control portion 150 and the control portion 350. If it is determined that the foil transfer ring process is selected (Yes at the step S100), then the control portion 150 goes to a step S101. If it is determined that the foil transferring process is not selected (No at the step S100), then the control portion 150 waits until the foil transferring process is selected.

At the step S101, the control portion 150 controls the feeding portion 20 to feed the waste sheet Pn on which the desired negative toner image is to be transferred from the feeding tray corresponding thereto and to convey the waste sheet Pn to the image forming portion 10. The control portion 150 then controls the feeding portion 20 to feed the printing sheet of paper Pp on which all the toner images including the desired positive toner image are to be transferred from the feeding tray corresponding thereto and to convey the printing sheet of paper Pp to the image forming portion 10. The control portion 150 controls the feeding portion 20 to feed the waste sheet Pn and the printing sheet of paper Pp alternately to the image forming portion 10 according to a number of the surface(s) of the sheet of paper on which the image is formed. For example, when the image is formed on a single surface of the sheet of paper, a total of two sheets of one sheet of the waste sheet Pn and one printing sheet of paper Pp are conveyed to the image forming portion 10. Alternatively, when the images are formed on two surfaces of the sheet of paper and both surfaces of the waste sheets Pn are used, a total of three sheets of one sheet of the waste sheet Pn and two printing sheets of paper Pp are conveyed to the image forming portion 10. When conveying the waste sheet Pn and the printing sheets of paper Pp to the image forming portion 10, the control portion 150 goes to a step S102.

At the step S102, the control portion 150 allows developing and printing the desired negative toner image corresponding to the desired negative foil image, to be not printed, on a surface of the waste sheet Pn fed from the feeding portion 20. Specifically, when the desired positive foil image of star image is transferred on the printing sheet of paper Pp, as shown in FIGS. 3A and 3B, the desired negative toner image 512 which reverses the star image is transferred on the waste sheet Pn. When both surfaces of the waste sheet Pn are used, after the desired negative toner image 512 has been transferred on a front surface of the waste sheet Pn, the waste sheet Pn is reversed in the reverse conveying path 60 and is again conveyed to the image forming portion 10. The desired negative toner image 512 is then transferred on a back surface of the waste sheet Pn. When transferring the desired negative toner image 512 on the waste sheet Pn, the waste sheet Pn is conveyed to the foil transferred apparatus 300A and the control portion 150 goes to a step S103.

At the step S103, the control portion 150 allows developing and printing all the toner images including the desired positive toner image corresponding to the desired positive foil image, to be printed, on a surface of the printing sheet of paper Pp fed from the feeding portion 20. For example, when the desired positive foil image of star image is transferred on the printing sheet of paper Pp, as shown in FIGS. 4A and 4B, all the toner images including the desired positive toner image 520 which is identical image to the desired positive foil image, to be printed, are transferred on the printing sheet of paper Pp. When both surfaces of the printing sheet of paper Pp are used, all the toner images including the desired positive toner image are transferred on both surfaces of the printing sheet of paper successively. After all the toner images including the desired positive toner image 520 have been transferred on a front surface of the printing sheet of paper Pp, the printing sheet of paper Pp is reversed in the reverse conveying path 60 and is again conveyed to the image forming portion 10. All the toner images including the desired positive toner image 520 are then transferred on a back surface of the printing sheet of paper Pp. When transferring all the toner images including the desired positive toner image 520 on the printing sheet of paper Pp, the printing sheet of paper Pp is conveyed to the foil transferred apparatus 300A and the control portion 150 goes to a step S104. Thus, in this embodiment, the transfer of the desired negative toner image on the waste paper Pn and the transfer of all the toner images including the desired positive toner image on the printing sheet of paper Pp are alternatively performed.

At the step S104, the control portion 150 determines whether or not the printing job finishes. For example, the control portion 150 determines whether or not all the positive toner images and the desired negative toner image are transferred according to the user's set number of the surface(s) of the sheet of paper on which the image is formed. If the control portion 150 determines that the printing job finishes, then the control portion 150 finishes tine image forming process on a series of foil transferring process. On the other hand, if the control portion 150 determines that the printing job has not yet finished, the control portion 150 goes back to the step S101 from which the above-mentioned image forming process is repeated.

Operation Example of Foil Transferring Apparatus

Figure 9:
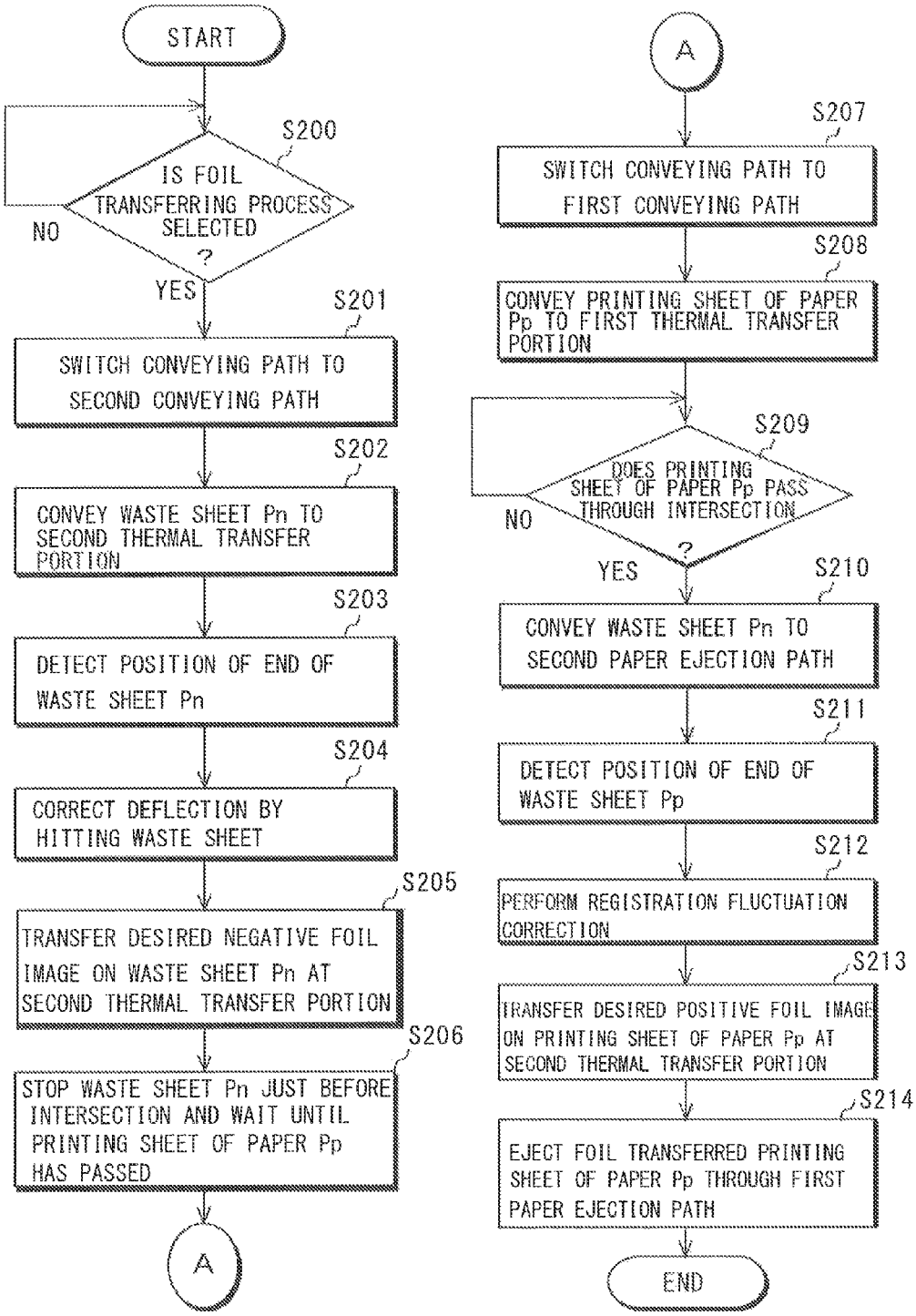
FIG. 9 is a flowchart showing an operation example of the foil transferring apparatus.

The following will describe an operation example of the foil transferring apparatus 300A. FIG. 9 shows an operation example of the control portion 350 of the foil transferring apparatus 300A. FIGS. 10A through 10D illustrate the foil sheet 500 and the waste sheet Pn explaining their conditions. FIGS. 11A through 11D are illustrations of the foil sheet 500 and the printing sheet of paper Pp explaining their conditions.

As shown in FIG. 9, at a step S200, the control portion 350 determines whether or not the foil transferring process is selected. For example, the control portion 350 determines whether or not it receives any selection information indicating a selection of the foil transferring process from the image forming apparatus 100 through the communication portion 390. If it is determined that the foil transferring process is selected, then the control portion 350 goes to a step S201. If it is determined that the foil transferring process is not selected, then the control portion 350 waits until the foil transferring process is selected.

At the step S201, the control portion 350 controls the gate switching portion 320 to switch the conveying path to the second conveying path R2. When the conveying path is switched to the second conveying path R2, the control portion 350 goes to a step S202. Further, when selecting the foil transferring process, the control portion 350 controls the driving portion 370 for the first heating roller 308*a* to drive the first heating roller 308*a* so that the reel portion 304 winds the foil sheet 500 set on the setting portion 302.

At the step S202, the control portion 350 controls the driving portion 372 for the conveying rollers 314, 316 to rotate them so that the waste sheet Pn on which the desired negative toner image is transferred, which is conveyed from the image forming apparatus 100, is conveyed to the second thermal transfer portion 306 through the second conveying path R2.

At a step S203, the second detection portion 310 detects the position of the end of the waste sheet Pn conveyed toward the second thermal transfer portion 306. The control portion 350 acquires any information on the position of the end of the waste sheet Pn, which is detected by the second detection portion 310, and controls the memory portion 340, for example, to store the acquired information on the position of the end of the waste sheet Pn. If the acquired information on the position of the end of the waste sheet Pn is stored on the memory portion 340, then the control portion 350 goes to a step S204.

At the step S204, the control portion 350 controls the registration rollers 318 to stop so that the deflection of the waste sheet Pn conveying through the second conveying path R2 is corrected by hitting a forward end of the waste sheet Pn against the stopped registration rollers 318 to form a loop. If the deflection of the waste sheet Pn is corrected, then the control portion 350 controls the registration rollers 318 and the like to convey the waste sheet Pn to the second thermal transfer portion 306 at a predetermined timing and goes to a step S205.

Figures 10A, 10B, 10C, 10D:
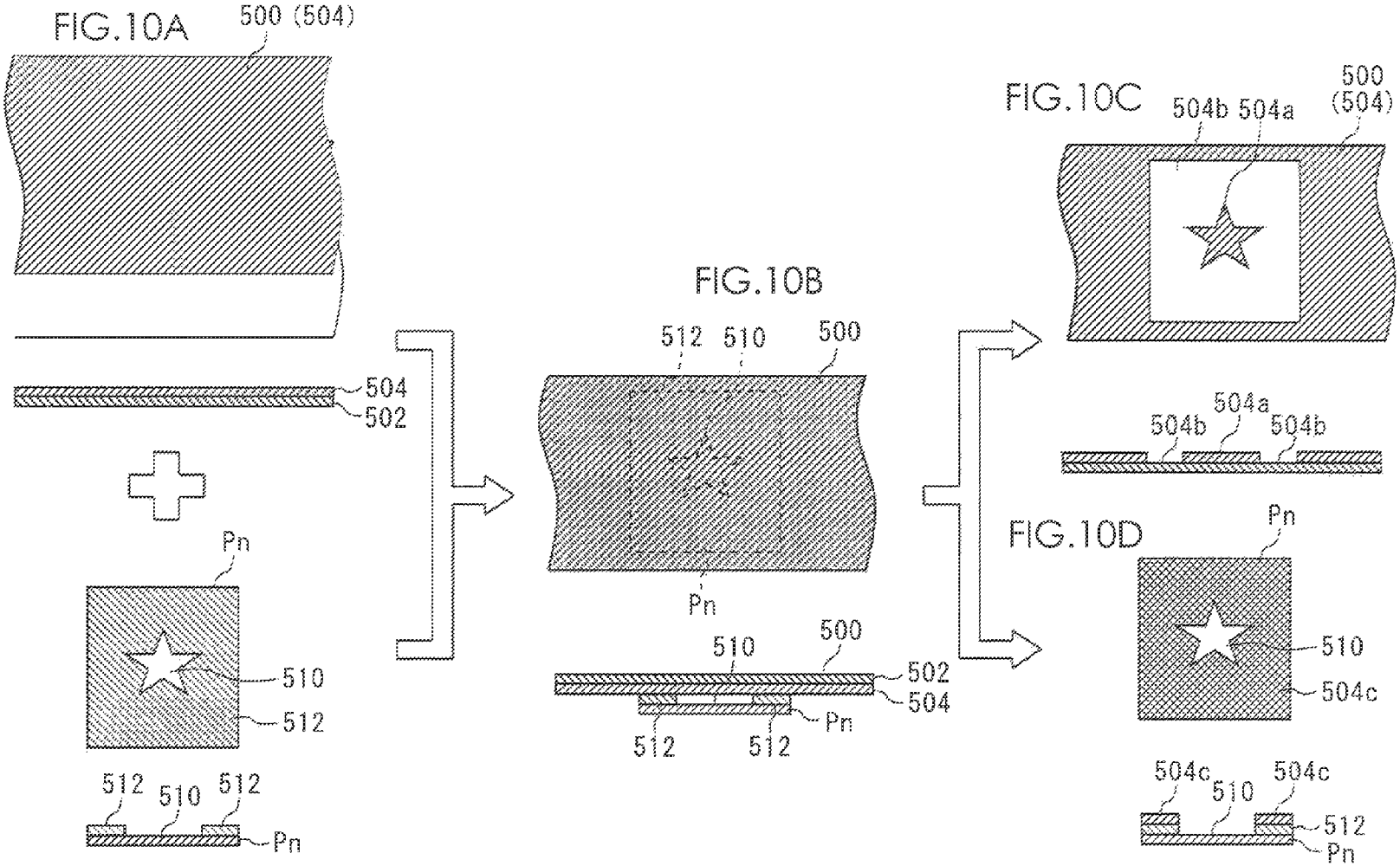
FIGS. 10A through 10D are illustrations of the foil sheet and one waste sheet explaining their conditions.

At the step S205, the control portion 350 controls the second thermal transfer portion 306 to lay the foil layer 504 of the foil sheet 500 on top of a surface of the waste sheet Pn, on which the desired negative toner image is transferred, to heat and pressure them. Thus, the desired negative foil image, to be not printed, is transferred onto the desired negative toner image on the waste sheet Pn. Specifically, as shown in FIGS. 10A and 10B, the second thermal transfer portion 306 lays the foil layer 504 of the foil sheet 500 on top of the surface of the waste sheet Pn, on which the desired negative toner image 512 is transferred, to heat and pressure them. Thus, as shown in FIG. 10D, the desired negative foil image 504*c* that reverses the desired positive foil image 504*a* of star image, to be printed, is transferred on the desired negative toner image 512 of the waste sheet Pn. On the other hand, as shown in FIG. 10C, the desired positive foil image 504*a* of star image, to be printed on the printing sheet of paper Pp, remains in the foil layer 504 of the foil sheet 500 and the recessed portion 504*b* having the same frame as that of the waste sheet Pn is formed. If the desired negative foil image 504*c* is transferred on the waste sheet Pn, then the control portion 350 goes to a step S206.

At the step S206, the control portion 350 controls the driving portion 376 for paper ejection rollers to rotate the paper ejection rollers 332 and the like so that the waste sheet Pn on which the desired negative foil image, to be not printed, is transferred by the second thermal transfer portion 306 is conveyed to the second paper election path R3. In this moment, in order to avoiding conflicting the waste paper Pn with the printing sheet of paper Pp at the intersection Pc, the waste sheet Pn stops just before the intersection Pc and waits until the printing sheet of paper Pp passes through the intersection Pc. Further, the control portion 350 may control the driving portion 376 for paper ejection rollers to reduce a conveying speed of the waste sheet Pn. If the waste sheet Pn is conveyed to the second paper ejection path R3, then the control portion 350 goes to a step S207.

At the step S207, when the waste sheet Pn is conveyed to the second thermal transfer portion 306, the control portion 350 controls the gate switching portion 320 to switch the conveying path to the first conveying path R1. For example, a sensor may be provided near the entrance 312 and the gate switching portion 320 may switch the conveying path after a predetermined period of time has elapsed since this sensor has detected the waste sheet Pn. The detection result of the second detection portion 310 may trigger the switch of the gate switching portion 320. If the conveying path is switched to the first conveying path R1, then the control portion 350 goes to a step S208.

At the step S208, the control portion 350 controls the driving portion 374 for the conveying rollers 322, 324, 326 to rotate them so that the printing sheet of paper Pp conveyed from the image forming apparatus 100 is conveyed to the first thermal transfer portion 308 through the first conveying path R1. In this moment, the control portion 350 controls the driving portion 374 for the conveying rollers 322, 324, 326 to increase a conveying speed of the printing sheet of paper Pp to convey the printing sheet of paper Pp to the registration rollers 328 which are provided just before the first thermal transfer portion 308, before the foil sheet 500 including the remained positive foil image 504*a* by the second thermal transfer portion 306 has reached the first thermal transfer portion 308. If the printing sheet of paper Pp is conveyed to the first conveying path R1, then the control portion 350 goes to a step S209.

At the step S209, the control portion 350 determines whether or not the printing sheet of paper Pp, on which the all the toner images including the desired positive toner image are transferred, passes through the intersection Pc of the first conveying path R1. For example, the control portion 350 determines whether or not the detection signal output from the sheet detection portion 360 is turned from on to off based on the passing of the end of the waste paper Pn. If it is determined that the printing sheet of paper Pp passes through the intersection Pc, then the control portion 350 goes to a step S210. On the other hand, if it is determined that the printing sheet of paper Pp does not pass through the intersection Pc, then the control portion 350 continues to watch until the printing sheet of paper Pp passes through the intersection Pc.

At the step S210, the control portion 350 controls the driving portion 376 for the paper ejection rollers to rotate the paper ejection rollers 332, 334, 336, 338 and 340 after the printing sheet of paper Pp passes through the intersection Pc so that the waste sheet Pn, on which the desired negative foil image, to be not printed, is transferred by the second thermal transfer portion 306, is ejected to the finisher 400 from the exit 364 via the second paper ejection path R3. If the waste sheet Pn is conveyed, then the control portion 350 goes to a step S211.

At the step S211, the first detection portion 330 detects the position of the end of the printing sheet of paper Pp conveyed toward the first thermal transfer portion 308. The control portion 350 acquires any information on the position of the end of the printing sheet of paper Pp, which is detected by the first detection portion 330, and controls the memory portion 340, for example, to store the acquired information on the position of the end of the printing sheet of paper Pp. If the acquired information on the position of the end of the printing sheet of paper Pp is stored on the memory portion 340, then the control portion 350 goes to a step S212.

At the step S212, the control portion 350 controls the registration rollers 328 to perform the registration fluctuation correction on the printing sheet of paper Pp, the position of the end of which is detected by the first detection portion 330. Specifically, the control portion 350 reads out of the memory portion 340 the information on the position of the end of the waste sheet Pn acquired in the step S203 and the information on the position of the end of the printing sheet of paper Pp acquired in the step S211. The control portion 350 calculates a difference between the read information on the position of the end of the printing sheet of paper Pp and the read information on the position of the end of the waste sheet Pn to calculate an amount of misregistration of the printing sheet of paper Pp in relation to the waste sheet Pn along the width direction D2. The control portion 350 prepares a command based on the calculated amount of misregistration and outputs the command to the adjustment portion 380. The control portion 350 controls the adjustment portion 380 to be driven based on the command and to allow the registration rollers 328 to perform the registration fluctuation correction in which the registration rollers 328 moves along the width direction D2 with the printing sheet of paper Pp being nipped. Accordingly, it is possible to align the desired positive toner image or the printing sheet of paper Pp with the desired positive foil image of the foil sheet 500. It is to be noted that the deflection of the printing sheet of paper Pp may be corrected by hitting the forward end of the printing sheet of paper Pp against the registration rollers 328 before this registration fluctuation correction.

After the registration fluctuation correction is finished, the control portion 350 calculates time when the desired positive foil image, to be printed, remained in the foil sheet 500 reaches the first thermal transfer portion 308 based on the timing in which the waste sheet Pn starts from the registration rollers 318. For example, the control portion 350 calculates time when the desired positive foil image, to be printed, on the foil sheet 500 reaches the first thermal transfer portion 308 based on a conveying speed of the foil sheet 500 and a distance to be conveyed between the first and second thermal transfer portions 306, 308 or the like. The control portion 350 controls the registration rollers 318 to be driven at the conveying start timing thereof to convey the printing sheet of paper Pp to the first thermal transfer portion 308.

Figures 11A, 11B, 11C, 11D:
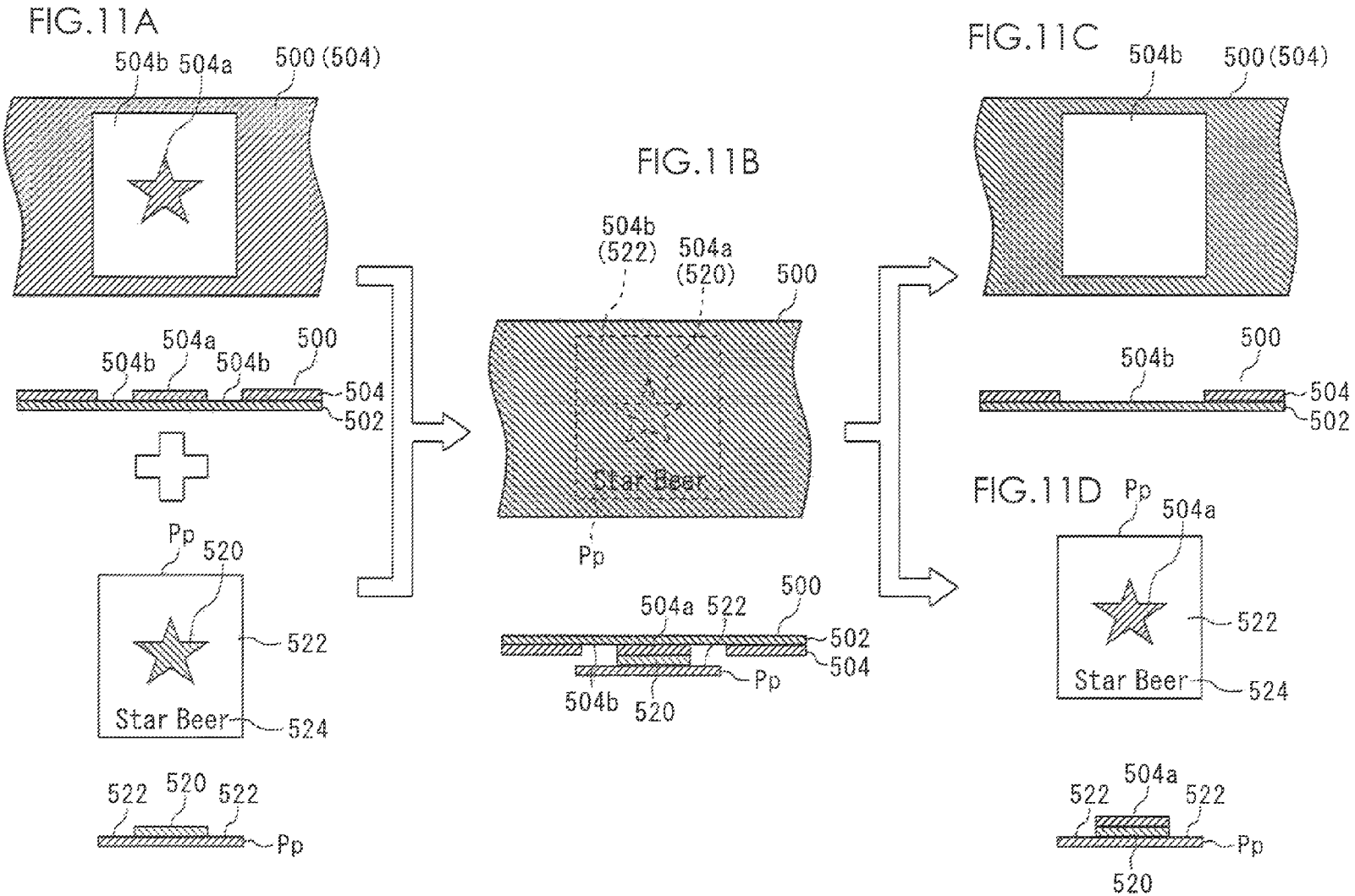
FIGS. 11A through 11D are illustrations of the foil sheet and the printing sheet of paper explaining their conditions.

At a step S213, the control portion 350 controls the first thermal transfer portion 308 to lay the foil layer 504 of the foil sheet 500 on top of a surface of the printing sheet of paper Pp, on which the desired positive toner image 520 is transferred, to heat and pressure them. Thus, the desired positive foil image, to be printed, is transferred from the foil sheet 500 onto the desired positive toner image on the printing sheet or paper Pp. Specifically, as shown in FIGS. 11A and 11B, the first thermal transfer portion 308 lays the foil layer 504 of the foil sheet 500 on top of the surface of the printing sheet of paper Pp, on which the desired positive toner image 520 is transferred, to heat and pressure them. Thus, as shown in FIG. 11D, the desired positive foil image 504*a* of star image, which remains in the foil sheet 500, is transferred on the desired positive toner image 520 of the printing sheet of paper Pp. No foil is transferred on the characters 524 of "Star Beer" as design image, which have been transferred on the printing sheet of paper Pp, because these characters are positioned at positions corresponding to the recessed portion 504*b*. On the other hand, as shown in FIG. 11C, the desired positive foil image 504*a* of star image, to be printed, is removed from the base member 502 so that in the foil layer 504 of the foil sheet 500, the recessed portion 504*b* having the frame corresponding to the size of the waste sheet Pn is formed. If the desired positive foil image 504*a* is transferred on the printing sheet of paper Pp, the control portion 350 goes to a step S214.

At the step S214, when the first thermal transfer portion 308 finishes the transfer of the desired positive foil image, to be printed, on the printing sheet of paper Pp, the control portion 350 controls the driving portion 378 for paper ejection rollers to rotate the paper ejection rollers 344, 346 so that the printing sheet of paper Pp is erected to the finisher 400 from the exit 302 via the first paper ejection path R4. Such a foil transfer processing enables the desired positive foil image to be transferred on the printing sheet of paper Pp.

As described above, according to the foil transferring apparatus 300A as this embodiment, since the desired negative foil image, to be not printed, of the foil sheet 500 is transferred on the waste sheet Pn in the second thermal transfer portion 306 at the upstream side and the desired positive foil image, to be printed, which remains on the foil sheet 500 and is not transferred on the waste sheet Pn, is transferred on the printing sheet of paper Pp in the first thermal transfer portion 308 at the downstream side, it is possible to transfer the desired positive foil image, to be printed, on the printing sheet of paper Pp automatically. Further, when any design images such as characters 524 of "Star Beer" are previously formed on the printing sheet of paper Pp, it is possible to transfer the desired positive foil image, to be printed, on the printing sheet of paper Pp with high positional accuracy without the foil transfer on the designs. This enables the foil to be transferred rapidly and continuously, which increases the productivity thereof.

Further, according to this embodiment, since the printing sheet of paper Pp aligns the waste sheet Pn before the printing sheet of paper Pp conveys the second thermal transfer portion 308 at the downstream side, it is possible to transfer the desired positive foil image on a desired position of the printing sheet of paper Pp with high positional accuracy.

Additionally, according to this embodiment, since both surfaces of the waste sheet Pn may be used by providing with the reverse conveying path R5, numbers of the waste sheet Pn disposed in the course of transferring the foil may be automatically reduced by half without taking a lot of time.

It is to be noted that although in the above-mentioned embodiment, the printing sheet of paper Pp has passed through the intersection Pc with priority to the waste sheet Pn, this invention is not limited thereto: For example, the waste sheet Pn may pass through the intersection Pc with priority to the printing sheet of paper Pp. In this case, in order to avoid colliding the waste sheet Pn with the printing sheet of paper Pp at the intersection Pc, a conveying speed of the waste sheet Pn may be controlled so as to be increased or a conveying speed of the printing sheet of paper Pp may be controlled so as to be reduced.

Second Embodiment

The second embodiment is different from the first embodiment in that the paper ejection path of the waste sheet Pn does not intersect the conveying path of the printing sheet of paper Pp. It is to be noted that other configuration of the image forming system GS including a foil transferring apparatus 300B is identical to that of the above-mentioned first embodiment so that the common components are referred by the same symbols and their detailed explanation will be omitted.

Configuration Example of Foil Transferring Apparatus

Figure 12:
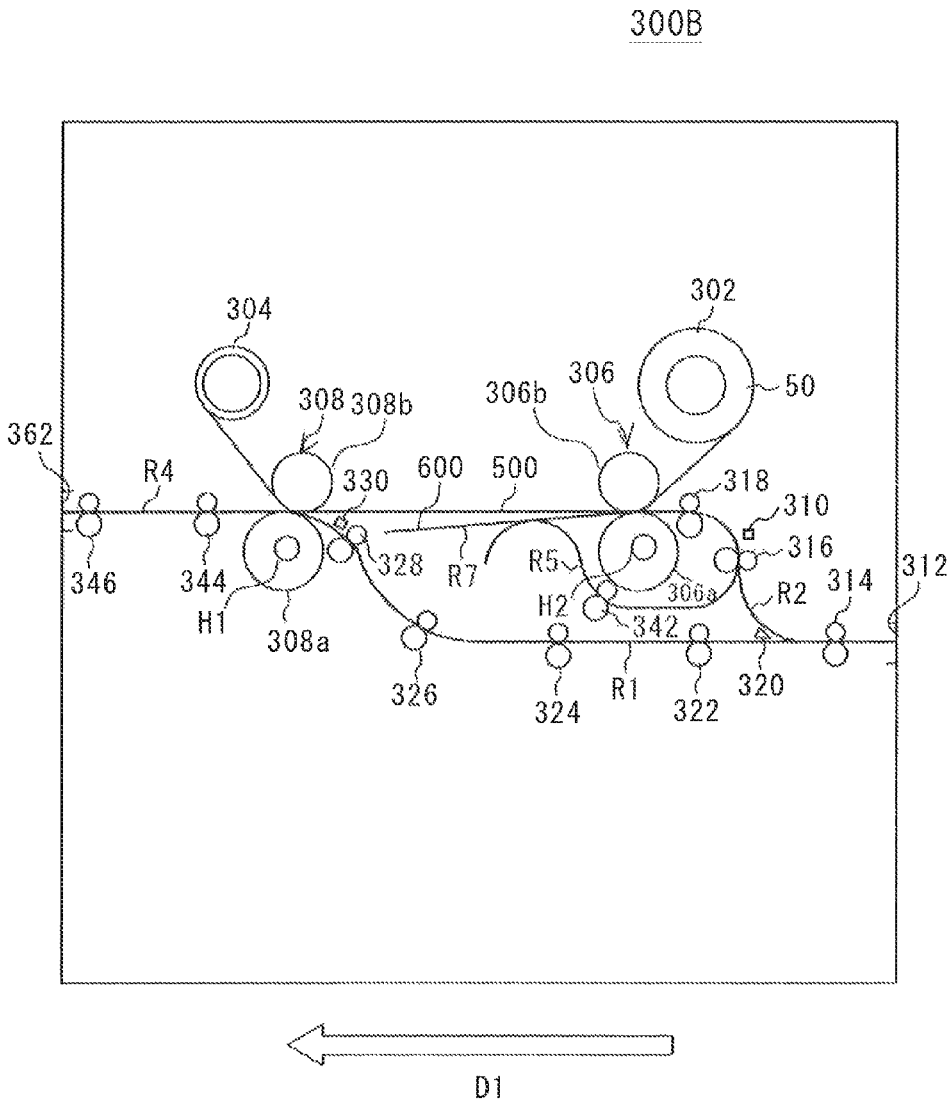
FIG. 12 is a diagram of a foil transferring apparatus according to a second embodiment of this invention showing a configuration example thereof.
Figure 13:
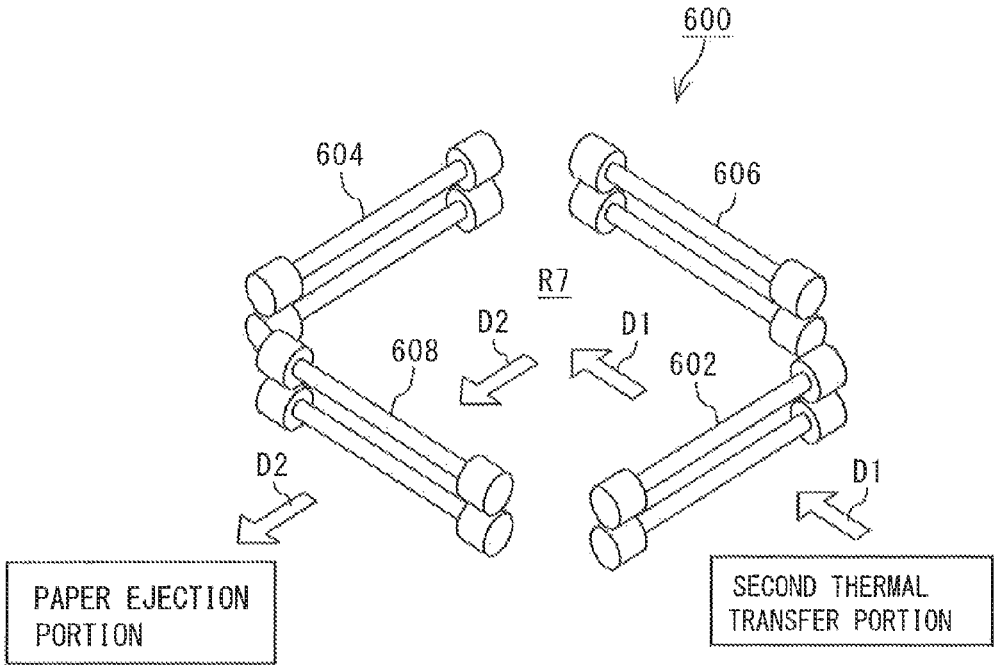
FIG. 13 is an illustration of a switching portion of paper ejection direction showing a configuration example thereof.

The following will describe the foil transferring apparatus 300B. FIG. 12 shows a configuration example of the foil transferring apparatus 300B. FIG. 12 shows a configuration example of the foil transferring apparatus 300B. FIG. 13 illustrates an example of a switching portion 600 of paper ejection direction. The foil transferring apparatus 300B, as shown in FIG. 12, is provided with a second paper ejection path R7 for ejecting the waste sheet Pn on which the desired negative foil image, to be not printed, is transferred. The second paper ejection path R7 extends diagonally downward along the sheet-conveying direction D1 from the second thermal transfer portion 306, changes its conveying direction at a downstream side thereof to the sheet width direction D2 that is perpendicular to the sheet-conveying direction D1 and extends to a front side of the foil transferring apparatus 300B. A paper ejection portion, not shown, for ejecting the waste sheet Pn passed through the second paper ejection path R7 toward outside is provided on the front side of the foil transferring apparatus 300B. It is to be noted that this paper ejection portion may be provided on the back side of the foil transferring apparatus 300B.

At the position where the conveying direction is changed on the second paper ejection path R7, the switching portion 600 of paper ejection direction, as shown in FIG. 13, for changing the conveying direction of waste sheet Pn from the sheet-conveying direction D1 to the sheet width direction D2 is arranged. The switching portion 600 of paper ejection direction contains rollers 602, 604 which are positioned so as to be away from each other by a predetermined distance along the sheet-conveying direction D1 and rollers 606, 608 which are positioned so as to be away from each other by a predetermined distance along the sheet width direction D2 that is perpendicular to the sheet-conveying direction D1. In this embodiment, the rollers 602, 604 and the rollers 606, 608 are respectively arranged at the positions that are positioned at least inward the smallest sized waste sheet Pn of the waste sheets Pn which can be used in the image forming system GS so that they can convey the smallest sized waste sheet Pn with it being nipped.

Each of the rollers 602, 604, 606 and 608 is provided with a pressuring and releasing portion, not shown, for releasing the nipping of the waste sheet Pn or for nipping the waste sheet. The pressuring and releasing portion is composed of, for example, a solenoid and a motor. The switching portion 600 of paper ejection direction contains plural sensors for detecting the waste sheet Pn. The control portion 350 controls the pressuring and releasing portion to nip the waste sheet Pn by each of the rollers 602, 604, 606 and 608 or to release the nipping of the waste sheet Pn based on the detection result of the waste sheet Pn by each of the sensors. The control portion 350 controls rotation of each of the rollers 602, 604, 606 and 608 based on the detection result of the waste sheet Pn by each of the sensors.

Operation Example of Foil Transferring Apparatus

The following will describe an operation example of the foil transferring apparatus 300B when the waste sheet Pn, on which the desired negative foil image, to be not printed, is transferred, is ejected. When the desired negative foil image is transferred on the waste sheet Pn, the waste sheet Pn is conveyed to the second paper ejection path R7. The rollers 602, 604 constituting the switching portion 600 of paper ejection direction convey the waste sheet Pn conveyed to the second paper ejection path R7 to the switching portion 600 of paper ejection direction. In this moment, the nipping by the rollers 606, 608 is released.

When conveying the waste sheet Pn to the switching portion 600 of paper ejection direction, the rollers 602, 604 stop and the nipping by the rollers 602, 604 is released. On the other hand, the rollers 606, 608 nip the waste sheet Pn and the rollers 606, 608 rotate. This enables the waste sheet Pn to be nipped by the rollers 606, 608 and the conveying direction of the waste sheet Pn to be changed from the sheet-conveying direction D1 to the sheet width direction D2. The waste sheet Pn, the conveying direction of which has been changed, is conveyed along the sheet width direction D2 in the second paper ejection path R7. The waste sheet Pn is ejected to the outside through the exit, not shown, provided on the front side of the foil transferring apparatus 300B.

As described above, according to the second embodiment, since there is no intersection when ejecting the waste sheet Pn, it is not necessary that the conveying speed of the waste sheet Pn is increased or reduced for preventing the waste sheet Pn from conflicting with the printing sheet of paper Pp. This allows any complex conveying control to be removed.

Although the present invention has been described with reference to the embodiments above, it is to be noted that the present invention is not limited to the embodiments, and various changes and modifications are possible to those who are skilled in the art insofar as they are within the scope of the invention. For example, although in the above-mentioned embodiments, the foil image to be transferred on the printing sheet of paper Pp has been star image, this invention is not limited thereto: Another image other than the star image can be adapted. Although in the above-mentioned embodiments, the characters 524 as the design images which are transferred on the printing sheet of paper Pp have been illustrated, this invention is not limited thereto: A design image such as other sign and/or device can be utilized. Although in the above-mentioned embodiments, the driving portions 372, 374 for conveying rollers and driving portions 376, 378 for paper ejection rollers in the foil transferring apparatus 300A or 300B has been described for convenience so as to have such a configuration that plural rollers are driven at the same time, this invention is not limited thereto: Respective rollers may be separately driven.

It should be understood by those skilled in the art that various modifications, combinations, sub-combinations and alterations may occur depending on design requirements and other factors insofar as they are within the scope of the appended claims or the equivalents thereof.

What is claimed is:

1. A foil transferring apparatus which transfers a desired positive foil image on a desired positive toner image selected among all the toner images formed on first base material using a fusion action of a toner, the apparatus comprising:

a setting portion that sets a roll on which a foil sheet including a foil layer on a surface thereof is wound;

a reel portion that winds the foil sheet of the roll;

a driving portion that conveys the foil sheet to the reel portion;

a foil sheet conveying path on which the foil sheet is conveyed by the driving portion;

a second thermal transfer portion that transfers a desired negative foil image to a second base material from the foil sheet, the second thermal transfer portion being positioned at an upstream side of the foil sheet conveying path;

a first thermal transfer portion that transfers the desired positive foil image, which is not transferred to the second base material by the second thermal transfer portion, to the first base material, the first thermal transfer portion being positioned at a downstream side of the foil sheet conveying path;

an entrance through which the first and second base materials are passed;

a first conveying path on which the first base material is conveyed from the entrance to the first thermal transfer portion;

a second conveying path on which the second base material is conveyed from the entrance to the second thermal transfer portion;

a switching portion that switches the conveying path from the first conveying path to the second conveying path or from the second conveying path to the first conveying path; and a control portion that controls the switching operation of the switching portion, wherein the control portion controls the switching portion to switch the conveying path from the first conveying path to the second conveying path when the first base material is conveyed and to switch the conveying path from the second conveying path to the first conveying path when the second base material is conveyed.

2. The foil transferring apparatus according to claim 1 further comprising:

a first paper ejection path that ejects the first base material on which the desired positive foil image is transferred in the first thermal transfer portion;

a second paper ejection path that ejects the second base material on which the desired negative foil image is transferred in the second thermal transfer portion; and an intersection portion that intersects the first conveying path and the second paper ejection path, wherein the control portion controls a conveyance of at least one of the first base material and the second base material in order to avoid colliding the first base material conveyed on the first conveying path with the second base material conveyed on the second paper ejection path in the intersection portion.

3. The foil transferring apparatus according to claim 1 further comprising:

a first detection portion that detects a position of an end of the first base material passing through the first conveying path;

a second detection portion that detects a position of an end of the second base material passing through the second conveying path; and an adjusting portion that adjusts a positional deviation of the first base material in relation to the second base material along a direction which is perpendicular to a conveying direction of the first base material, wherein the control portion controls the adjusting portion to move the first base material to the direction which is perpendicular to the conveying direction of the first base material based on detection results of the positions of the ends of the first and second base materials by the first and second detection portions.

4. The foil transferring apparatus according to claim 1 further comprising a reverse conveying path in which the second base material on which the desired negative foil image is transferred is inversed and conveyed again to the second conveying path.

5. The foil transferring apparatus according to claim 1 further comprising a manipulation/display portion that sets an image relating to a foil processing area in which the foil is transferred onto the image selected among all the images.

6. The foil transferring apparatus according to claim 1 wherein all the toner images including the desired positive toner image are transferred to the first base material in order to transfer the desired positive foil image, and the desired negative toner image is transferred to the second base material in order to transfer the desired negative foil image.

7. An image forming system which forms a desired positive foil image on a desired positive toner image selected among all the toner images formed on first base material using a fusion action of a toner, the system comprising:

an image forming apparatus which forms all the toner images on the first base material, the toner images including the desired positive toner image, to transfer the desired positive foil image on the desired positive toner image using the fusion action of the toner, and forms a desired negative toner image on second base material to transfer a desired negative foil image; and a foil transferring apparatus which transfers the desired positive foil image on the first base material using a fusion action of the desired positive toner image selected among all the toner images formed on the first base material, the foil transferring apparatus including:

a setting portion that sets a roll on which a foil sheet including a foil layer on a surface thereof is wound;

a reel portion that winds the foil sheet of the roll;

a driving portion that conveys the foil sheet to the reel portion;

a foil sheet conveying path on which the foil sheet is conveyed by the driving portion;

a second thermal transfer portion that transfers the desired negative foil image to the second base material from the foil sheet, the second thermal transfer portion being positioned at an upstream side of the foil sheet conveying path;

a first thermal transfer portion that transfers the desired positive foil image, which is not transferred to the second base material by the second thermal transfer portion, to the first base material, the first thermal transfer portion being positioned at a downstream side of the foil sheet conveying path;

an entrance through which the first and second base materials are passed;

a first conveying path on which the first base material is conveyed from the entrance to the first thermal transfer portion;

a second conveying path on which the second base material is conveyed from the entrance to the second thermal transfer portion;

a switching portion that switches the conveying path from the first conveying path to the second conveying path or from the second conveying path to the first conveying path; and a control portion that controls the switching operation of the switching portion, wherein the control portion controls the switching portion to switch the conveying path from the first conveying path to the second conveying path when the first base material is conveyed and to switch the conveying path from the second conveying path to the first conveying path when the second base material is conveyed.

8. The image forming system according to claim 7 further comprising:

a first paper ejection path that ejects the first base material on which the desired positive foil image is transferred in the first thermal transfer portion;

a second paper ejection path that ejects the second base material on which the desired negative foil image is transferred in the second thermal transfer portion; and an intersection portion that intersects the first conveying path and the second paper ejection path, wherein the control portion controls a conveyance of at least one of the first base material and the second base material in order to avoid colliding the first base material conveyed on the first conveying path with the second base material conveyed on the second paper ejection path in the intersection portion.

9. The image forming system according to claim 7 further comprising:

a first detection portion that detects a position of an end of the first base material passing through the first conveying path;

a second detection portion that detects a position of an end of the second base material passing through the second conveying path; and an adjusting portion that adjusts a positional deviation of the first base material in relation to the second base material along a direction which is perpendicular to a conveying direction of the first base material, wherein the control portion controls the adjusting portion to move the first base material to the direction which is perpendicular to the conveying direction of the first base material based on detection results of the positions of the ends of the first and second base materials by the first and second detection portions.

10. The image forming system according to claim 7 further comprising a reverse conveying path in which the second base material on which the desired negative foil image is transferred is inversed and conveyed again to the second conveying path.

11. The image forming system according to claim 7 further comprising a manipulation/display portion that sets an image relating to a foil processing area in which the foil is transferred onto the image selected among all the images.

12. The image forming system according to claim 7 wherein all the toner images including the desired positive toner image are transferred to the first base material in order to transfer the desired positive foil image, and the desired negative toner image is transferred to the second base material in order to transfer the desired negative foil image.

* * * * *